US010626597B2

(12) United States Patent
Strickland

(10) Patent No.: US 10,626,597 B2
(45) Date of Patent: Apr. 21, 2020

(54) SEAL ASSEMBLY AND LIGHT WEIGHT EXTERIOR WALL SYSTEM USING SAME

(71) Applicant: INVENT TO BUILD INC., Richmond Hill (CA)

(72) Inventor: Michael R. Strickland, Richmond Hill (CA)

(73) Assignee: INVENT TO BUILD INC., Richmond Hill, ON (CA)

( * ) Notice: Subject to any disclaimer, the term of this patent is extended or adjusted under 35 U.S.C. 154(b) by 0 days.

(21) Appl. No.: 16/127,466

(22) Filed: Sep. 11, 2018

(65) Prior Publication Data

US 2019/0078323 A1 Mar. 14, 2019

Related U.S. Application Data

(60) Provisional application No. 62/556,861, filed on Sep. 11, 2017, provisional application No. 62/648,754, filed on Mar. 27, 2018.

(51) Int. Cl.
*E04B 1/68* (2006.01)

(52) U.S. Cl.
CPC ..... *E04B 1/6815* (2013.01); *E04B 1/6812* (2013.01); *E04B 1/6813* (2013.01)

(58) Field of Classification Search
CPC ..... E04B 1/68; E04B 1/6812; E04B 1/6813; E04B 1/6815; E04B 9/244; E04B 2/88; E04F 13/0891
See application file for complete search history.

(56) References Cited

U.S. PATENT DOCUMENTS

| | | | |
|---|---|---|---|
| 2,680,370 | A | 6/1954 | Spaight |
| 3,099,110 | A | 7/1963 | Spaight |
| 3,205,629 | A | 9/1965 | Rumley et al. |
| 3,788,021 | A | 1/1974 | Husler |
| 4,110,948 | A | 9/1978 | Maier, Jr. |

(Continued)

FOREIGN PATENT DOCUMENTS

| | | | |
|---|---|---|---|
| CA | 2166593 | A1 | 7/1997 |
| DE | 202004017823 | U1 | 3/2006 |

(Continued)

OTHER PUBLICATIONS

International Search Report for PCT/CA2018/051118, dated Jan. 24, 2019.

*Primary Examiner* — Andrew J Triggs
(74) *Attorney, Agent, or Firm* — Hill & Schumacher

(57) ABSTRACT

This disclosure discloses a dry seal system for use with a wall comprised of exterior insulated wall panels wherein the dry seal system is used to seal the joints between the exterior insulated wall panels. The dry seal system generally comprises a seal assembly for sealing a joint between horizontally adjacent exterior insulated wall panels and may further comprise a horizontal seal for sealing vertically adjacent exterior insulated wall panels. The seal assembly generally comprises a first connector, a second connector and a vertical seal, wherein the first connector is attached to one exterior insulated wall panel, the second connector is attached to another exterior insulated wall panel, the vertical seal is positioned between the first connector and the second connector and the first connector engages the second connector to provide a seal.

20 Claims, 30 Drawing Sheets

(56) References Cited

U.S. PATENT DOCUMENTS

| | | | | |
|---|---|---|---|---|
| 4,614,067 | A * | 9/1986 | Matsubara | E04B 1/6803 52/200 |
| 4,884,381 | A | 12/1989 | Betti | |
| 5,076,034 | A | 12/1991 | Bandy | |
| 5,092,095 | A | 3/1992 | Zadok et al. | |
| 5,129,754 | A | 7/1992 | Brower | |
| 5,347,778 | A | 9/1994 | Bray | |
| 5,469,683 | A | 11/1995 | McKenna et al. | |
| 8,132,380 | B2 | 3/2012 | Wilkes, Jr. | |
| 9,464,432 | B2 | 10/2016 | Lang et al. | |
| 2019/0078323 | A1 * | 3/2019 | Strickland | E04B 2/88 |

FOREIGN PATENT DOCUMENTS

| | | | |
|---|---|---|---|
| FR | 3017684 | A1 | 2/2014 |
| GB | 249165 | | 1/1927 |
| JP | 2015163762 | A | 9/2015 |
| KR | 200420845 | Y1 | 7/2006 |
| WO | 9913174 | | 3/1999 |
| WO | 2007048188 | A1 | 5/2007 |
| WO | 2017017053 | A1 | 2/2017 |

* cited by examiner

SEAL ASSEMBLY AND LIGHT WEIGHT EXTERIOR WALL SYSTEM USING SAME

FIELD OF THE DISCLOSURE

This disclosure relates to seal assemblies and in particular a seal assembly for use with light weight exterior wall panels systems that include panel joint seals.

BACKGROUND

There are two commonly used light weight exterior wall panel systems used in the construction industry today, namely aluminum framed curtain walls and exterior insulated finish system (EIFS).

Aluminum framed curtain wall panels are the most common method for providing exterior walls on multi-story buildings, they have extruded dry-seal systems incorporated that protect the building against air and water infiltration and provide superior longevity. A dry seal system can be designed to incorporate the Rain Screen Principle, so the joint can be pressure equalized to help keep moisture away from the seals. The panels can incorporate windows, stone finish or a metal finish. The downside of aluminum framed curtain wall panels is that they perform quite poorly regarding thermal protection of the building.

Exterior insulated panels (sometimes referred to as E.I.F.S.) are becoming more commonly used today for multi-story curtain wall construction. When these panels are properly designed and installed, they will provide optimum thermal protection for a building. Unfortunately, this type of construction typically requires the joints between the panels to be caulked after the panels are erected. Caulking is what is known as a wet-seal system, they are subject to human error and inclement weather. Caulked joints do not provide the same level of quality and endurance as dry-seal systems and incorporating the Rain Screen Principle is difficult to do with caulked joints. Unfortunately caulking the joints needs to be done using scaffolding or swing stages located on the outside of the building, this can be costly and makes the work more dangerous to do. The latter is expensive and adds time required to complete the installation. Caulking is also problematic when the proximity of the adjacent building is too close to the new wall to allow access.

Both of these commonly used systems have disadvantages. In regard to the aluminum framed curtain wall panels it would be advantageous to provide a wall system that has better thermal characteristics. In regard to Exterior Insulated panels (EIFS) it would be advantageous to provide a wall system that incorporates dry seals and reduces onsite work thus reducing the labor costs and inherently increasing the quality of the wall system. It would be further advantageous to provide pressure equalized seal system that also provides a means for moisture to drain from within the seal system.

SUMMARY

The present disclosure relates to a seal assembly for use with exterior insulated wall panels. The seal assembly has a top and a bottom. The seal assembly includes a first connector, a second connector and a vertical seal. The first connector is attached to one of a first and a second exterior insulated panel. The second connector is attached to the other of the first and second exterior panel. The vertical seal is attached to one of the first and second connector. The first and second connectors are configured to be connected together such that the first and second exterior insulated panels are horizontally adjacent so as to connect and seal horizontally adjacent exterior insulated panels.

The vertical seal may include a vertical seal base and at least a first projection and a second projection extending outwardly therefrom wherein the first projection and second projection are resiliently deformable.

The first connector may have a pair of ends and the second connector may have a pair of ends wherein the first connector has a hook on either end thereof adapted to engage a channel on either end of the second connector. The exterior insulated panel of the first and second exterior insulated panels to which the first connector is attached may be pivoted relative to the other of the first and second exterior insulated panels such that the hooks of the first connector engage the channels of the second connector to provide a seal between the first and second exterior insulated panels.

The seal assembly may include a first thermal separator between the first connector and the exterior insulated panel to which it is attached and a second thermal separator between the second connector and exterior insulated panel to which it is attached.

The first connector may include a first portion and a second portion connected with a connector thermal separator. The second connector may include a first portion and a second portion connected with a connector thermal separator.

The seal assembly may include a top chamber plate positioned at the top of the seal assembly and a bottom chamber plate positioned at the bottom of the seal assembly.

The vertical seal may include two pairs of opposed sides wherein one pair of opposed sides each have a bend therein such that the bend is resilient facilitate the other pair of opposed sides to be pushed closer together under pressure. The seal assembly may include a plurality of feet extending outwardly from one pair of opposed sides such that the feet engage the first and second connectors.

The second connector may include a leg extension portion extending outwardly from the channel.

The seal assembly may include a pair of plugs positioned at the top and the bottom of the seal assembly. Each plug may have a body portion and a sloped portion and the sloped portion is positioned for drainage and air circulation. The seal assembly may include a bottom seal boot inside the bottom of the seal assembly and a top seal boot inside the top of the seal assembly.

An exterior wall system includes a plurality of exterior insulated wall panels, a plurality of seal assemblies and a plurality of horizontal seals. The seal assemblies are connected between horizontally adjacent exterior insulated wall panels. The plurality of horizontal seals are between vertically adjacent panels.

At least four wall exterior insulated panels are arranged to form a 4-way joint and wherein plates are buttered with silicone and installed to the top and bottom of the seal assembly to span horizontally across the 4-way joint above and below the horizontal seal, thereby providing a continuous sealing surface for the horizontal seals to bear against.

The plates may be installed to span horizontally across the top and bottom of the seal assembly and the plates are buttered with silicone and attached to the top and bottom of the seal assembly.

The vertical seal chamber may have holes along a vertical exterior face, thereby providing a means for inducing pressure equalization in the vertical seal chamber when air pressure differences experienced by the vertical seal.

The horizontal seals may be buttered onto a top of the exterior insulated panels.

The exterior wall system may include at least one positioning pin between vertically adjacent wall exterior insulated panels.

A horizontal seal for use with horizontally adjacent exterior insulated wall panels includes a base, a top, an exterior wall and an interior wall. The base has at least a pair of spaced apart base feet extending downwardly therefrom. The top is spaced apart from the base and has at least a pair of spaced apart top feet extending upwardly therefrom. The exterior wall extends between the base and the top and the exterior wall has a bend therein. The interior wall extends between the base and the top and the interior wall has a bend therein. The base, the top, the exterior wall and the interior wall define a tubular member and the bend in the exterior wall and the bend in the interior wall facilitates movement of the base relative to the top.

The base feet may be aligned with exterior wall and the interior wall. The top feet may be aligned with the exterior wall and the interior wall.

The horizontal seal may include a chamber wall positioned between the exterior wall and the interior wall and extending between the base and the top, thereby forming two chambers.

The horizontal seal may include a plurality of chamber walls positioned between the exterior wall and the interior wall and extending between the base and the top, thereby forming a plurality of chambers.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

Figure 1:
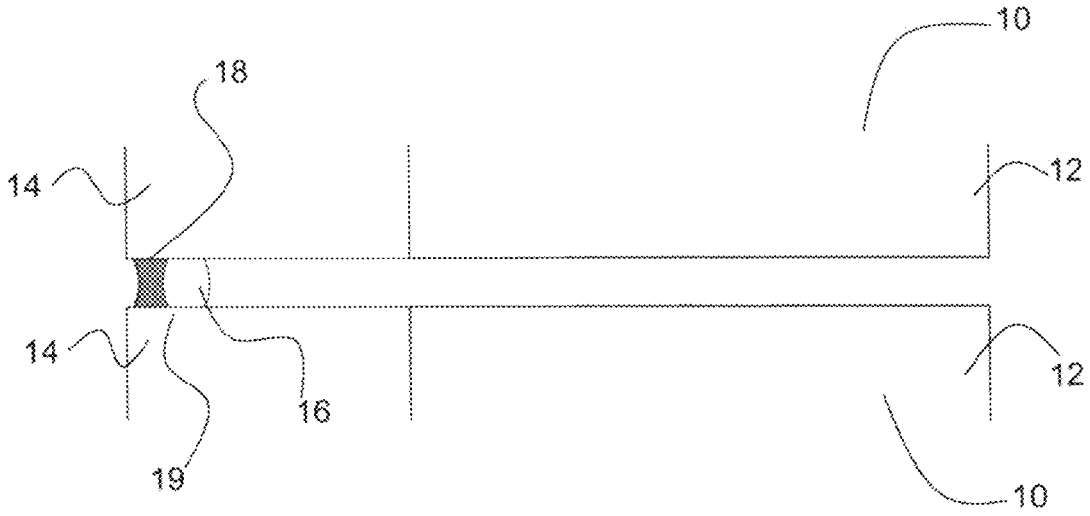
Fig. 1 (PRIOR ART)
FIG. 1 is a top view of a prior art joint used in an exterior insulation finishing system.
Figure 2:
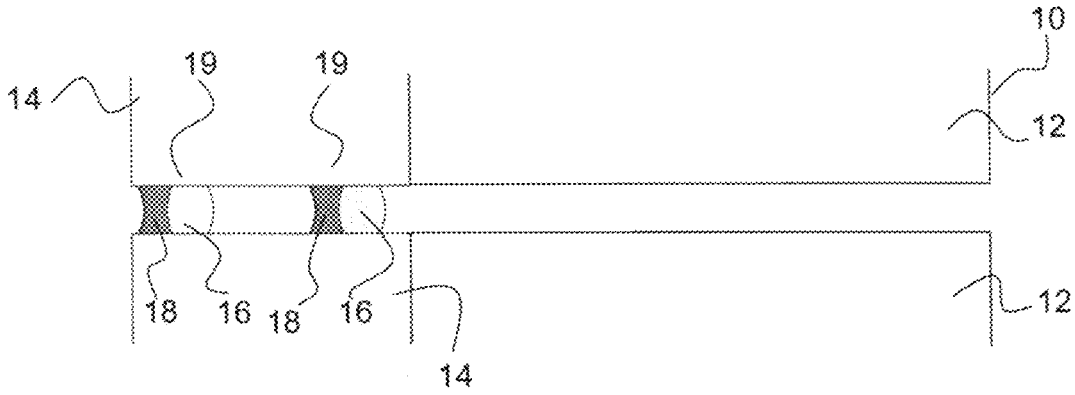
Fig. 2 (PRIOR ART)
FIG. 2 is a top view of an alternate prior art joint used in an exterior insulation finishing system.

Referring to FIGS. 1 and 2 prior art sealing systems used with exterior insulated panels 10. The exterior insulated panel 10 typically includes a light steel frame portion 12 and an exterior insulation portion 14. The panels 10 are joined with a backing rod 16 and caulking 18. The panels 10 may have one joint 19 as shown in FIG. 1 or two joints 19 as shown in FIG. 2. It will be appreciated by those skilled in the art that the joints 19 are installed on site and they are very labor intensive to install on site.

Figure 3:
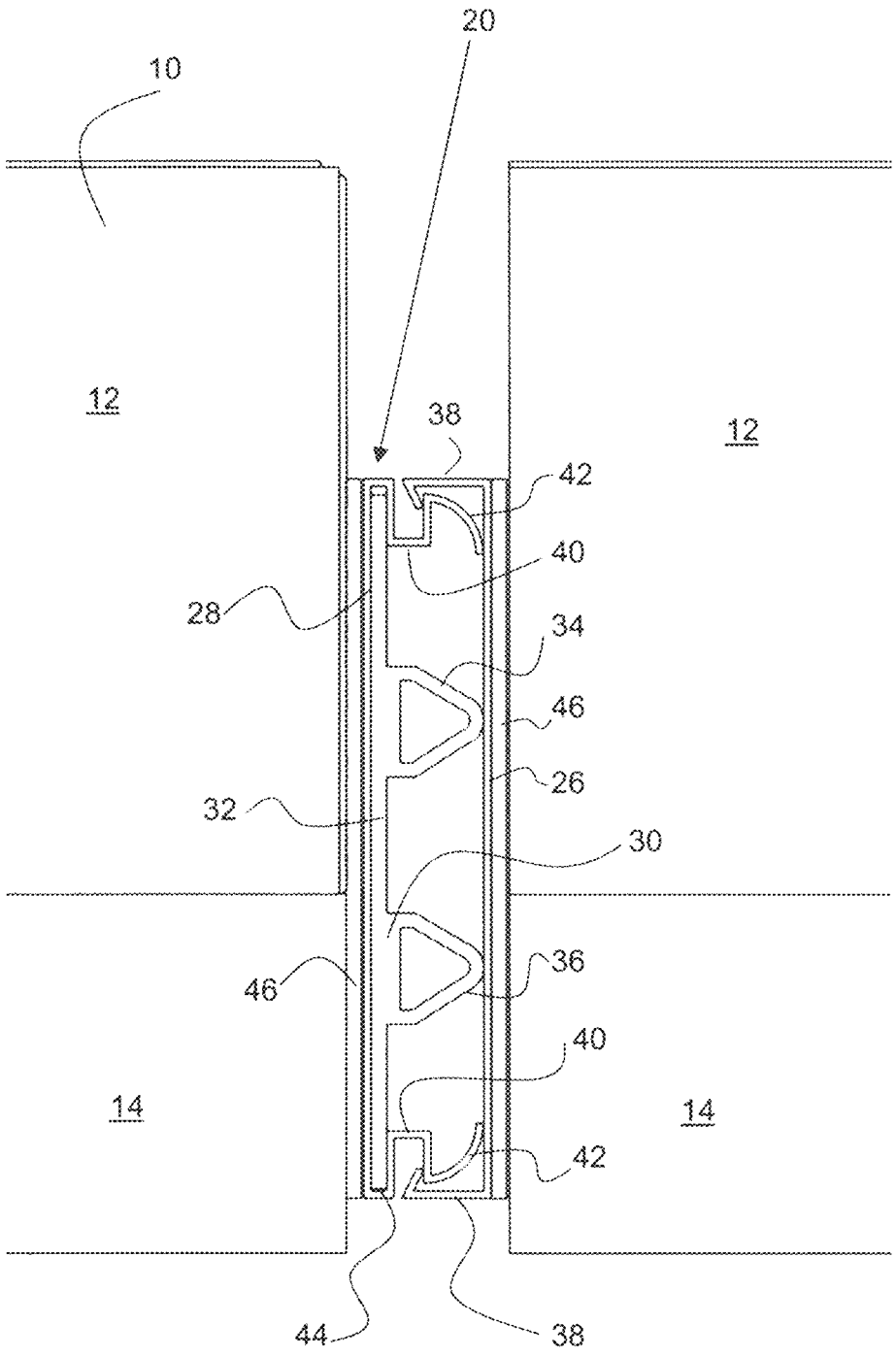
FIG. 3 is a top view of a vertical seal assembly between adjacent exterior wall panels as used in a light weight exterior wall system.
Figure 12:
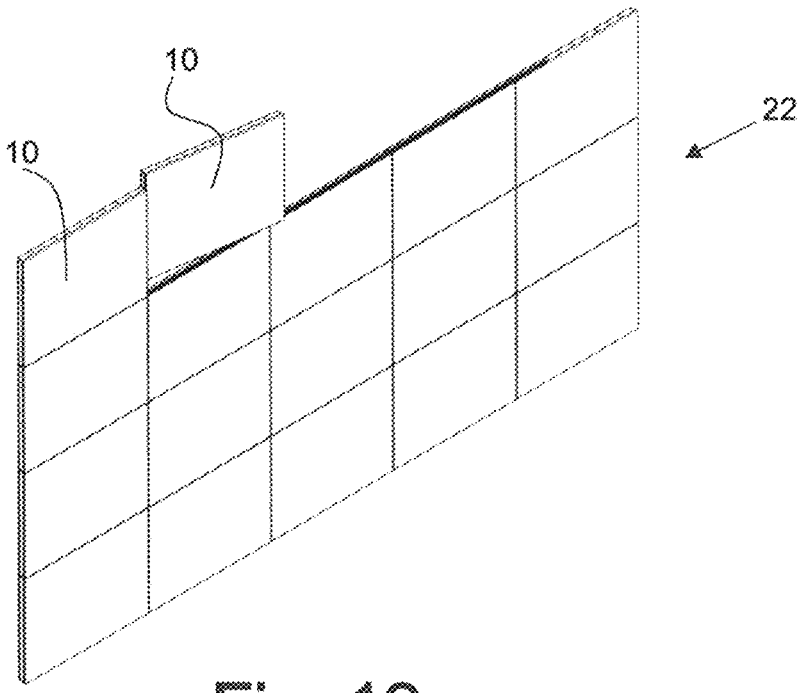
FIG. 12 is a perspective view of an exterior wall system.
Figure 13:
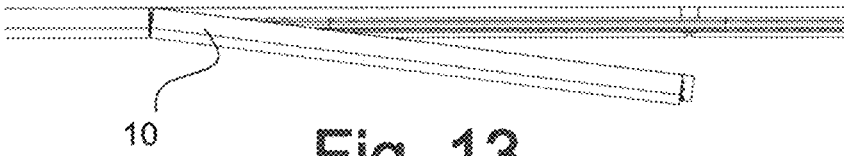
FIG. 13 is a top view of the exterior wall system showing an exterior wall panel about to be snapped into place.
Figure 14:
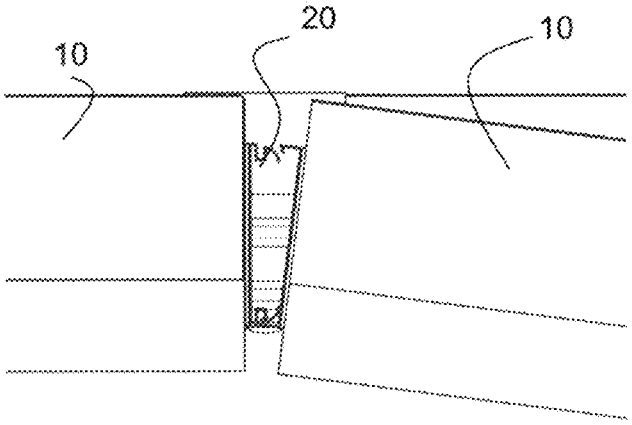
FIG. 14 is an enlarged top view of FIG. 13 showing the seal assembly.
Figure 15A:
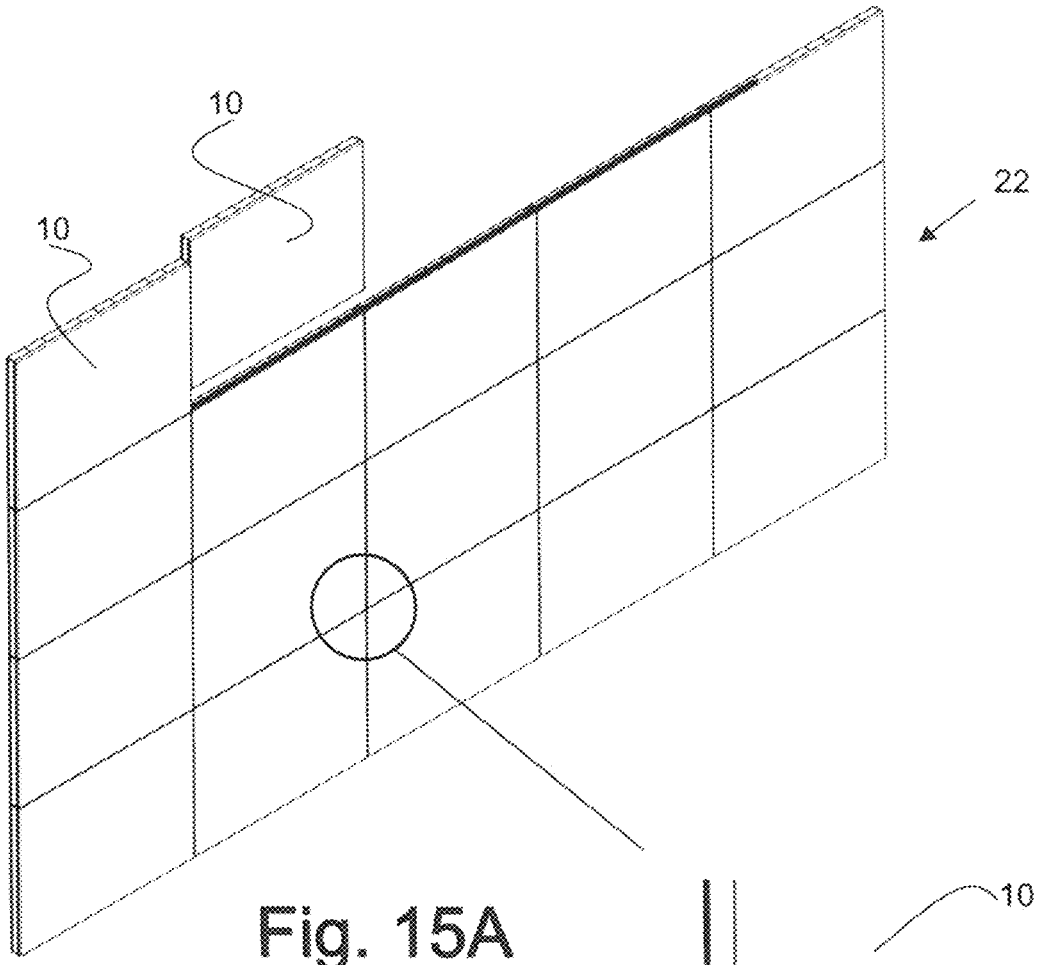
FIG. 15A is a perspective view of the exterior wall system.
Figure 15B:
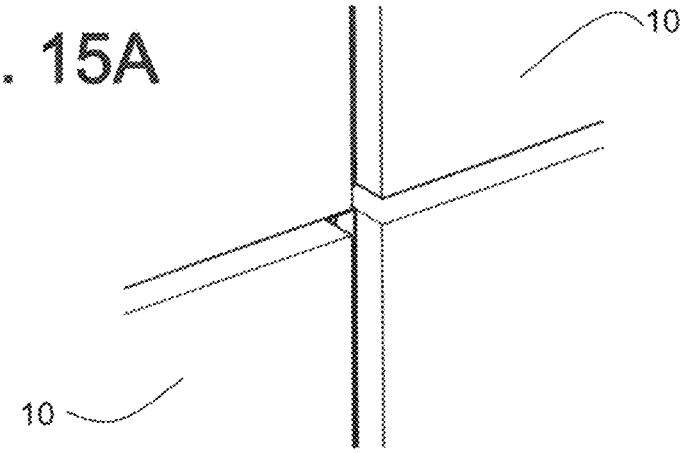
FIG. 15B is an enlarged perspective view of a 4-way joint of the exterior wall system of FIG. 15A.
Figure 16:
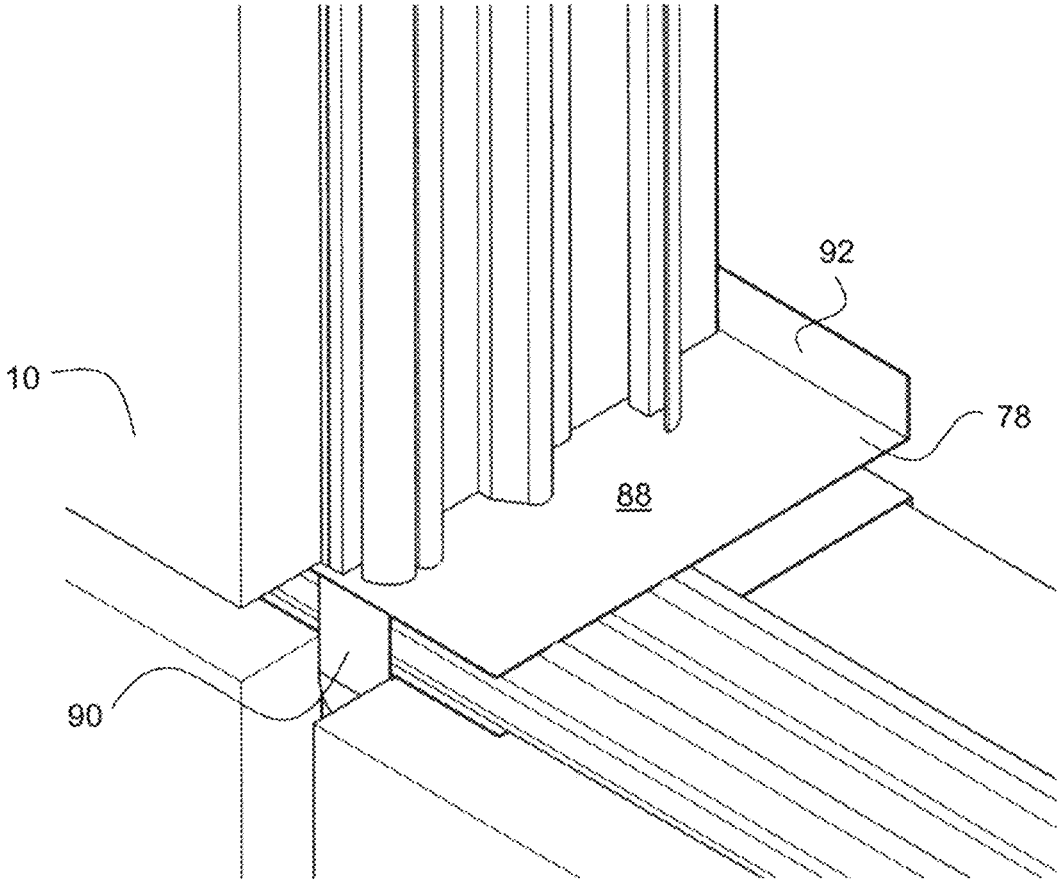
FIG. 16 is perspective view of the four way joint of the exterior wall system of FIG. 15B but showing one of the exterior wall panels removed.
Figure 17:
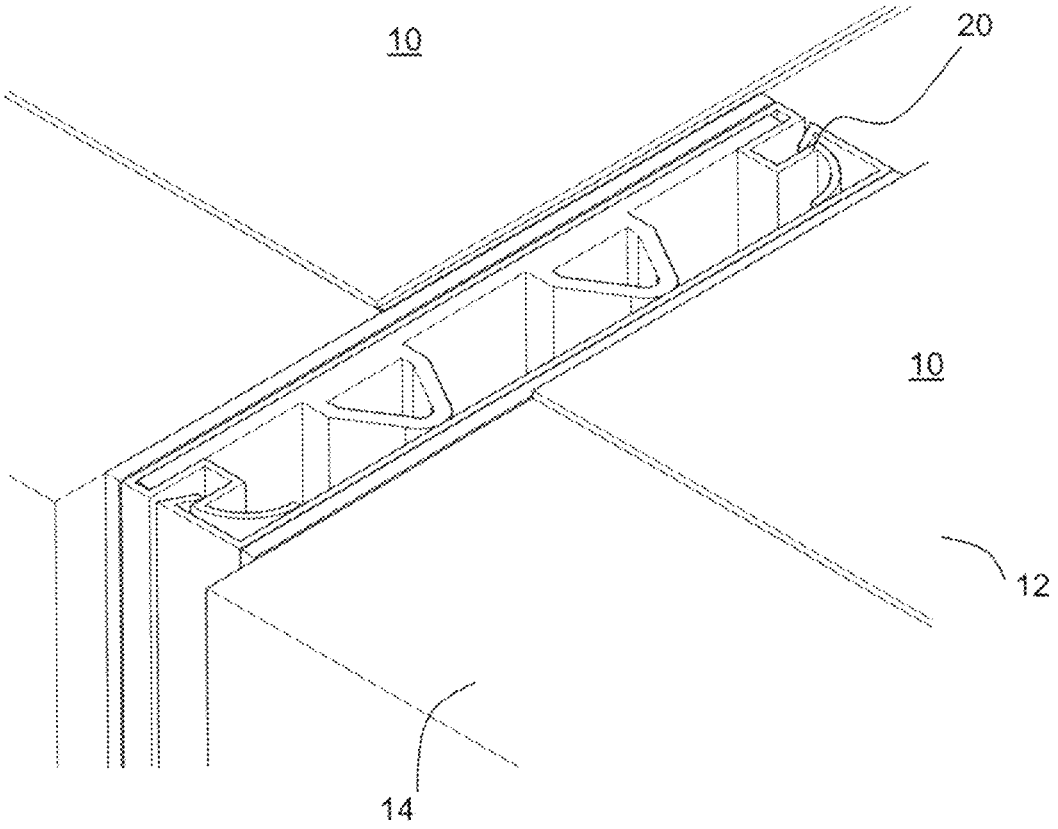
FIG. 17 is a perspective view of the seal assembly shown between adjacent wall panels.
Figure 18:
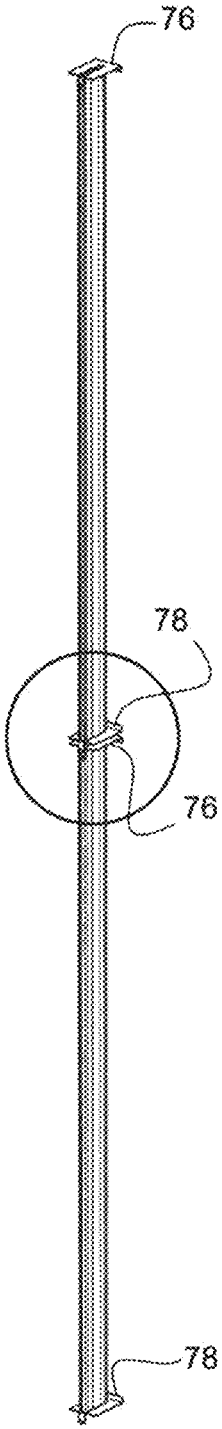
FIG. 18 is a perspective view of two seal assemblies arranged as they would be in a 4-way joint.
Figure 19:
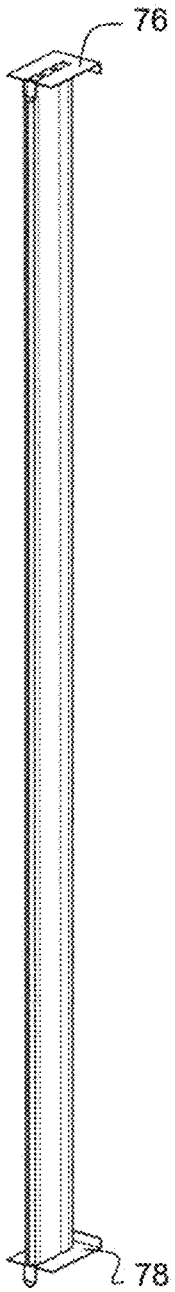
FIG. 19 is an enlarged perspective view of a seal assembly shown with top chamber plate and a bottom chamber plate.

Referring to FIG. 3, a vertical seal assembly is shown generally at 20. The vertical seal assembly 20 is for use with exterior wall panels and in particular exterior insulated panels 10. The vertical seal assembly 20 forms part of an exterior wall system 22 shown in FIG. 12. The exterior wall system 22 includes a plurality of exterior wall panels 10 wherein horizontally adjacent wall panels are connected on their vertical side with seal assemblies 20. The exterior wall system 22 may also include horizontal seals 24 between vertically adjacent wall panels.

The vertical seal assembly 20 includes a pair of connectors namely a first connector 26 and a second connector 28 and a vertical seal 30. The first 26 and second 28 connectors engage each other. The vertical seal 30 includes a vertical seal base 32 and at least a first projection 34 and a second projection 36. The first projection 34 and second projection 36 are spaced apart. The vertical seal 30 is made of a resilient deformable material such that the vertical seal 30 has a memory of the shape of the first projection 34 and the second projection 36. The first 34 and second 36 projection extend outwardly from the vertical seal base 32. The first 34 and second 36 projections are dimensioned so that when the first 26 and second 28 connectors are connected the first 34 and second 36 projections are pressed between the connectors 26 and 28 and deformed slightly to ensure a good seal.

The first 26 and second 28 connectors are made from cold rolled steel. The first connector 26 has hooks 38 projecting inwardly from each end thereof. The second connector 28 has a pair of channels 40 formed therein and projecting inwardly from each end thereof. A guide 42 extends inwardly from each channel 40. When the first 26 and second 28 connectors are connected, the hooks 38 engage the channels 40 and the guides 42 help them to be guided into place. A seal channel 44 is formed on either side of the second connector 28. The vertical seal 30 is positioned in the seal channels 44. The engagement between the hook 38 and the channel 40 accommodates a small amount of movement due to fabrication tolerance and thermal expansion/contraction. By way of example only, in a typical wall system the assembly and fabrication tolerances are +/−1/16 inch and the thermal expansion is +/−1/8 inch.

The first connector 26 is attached to one exterior insulated panel 10 and the second connector 28 is attached to another exterior insulated panel 10. The hooks 38 on the first connector 26 and the channels 40 on the second connector 28 are configured such that a snap in place connection may be achieved. The connectors are designed such that a hook 38 on one side of the first connector 26 engages a channel 40 on one side of the second connector 28. One panel 10 is then pivoted around the engaged hook 38 and channel 40 until the other hook and channel 40 are snapped in place and the horizontally adjacent panels 10 are connected.

A pair of thermal separators 46 are positioned between the first 26 and second 28 connectors and the exterior insulated panels 10.

Figure 4:
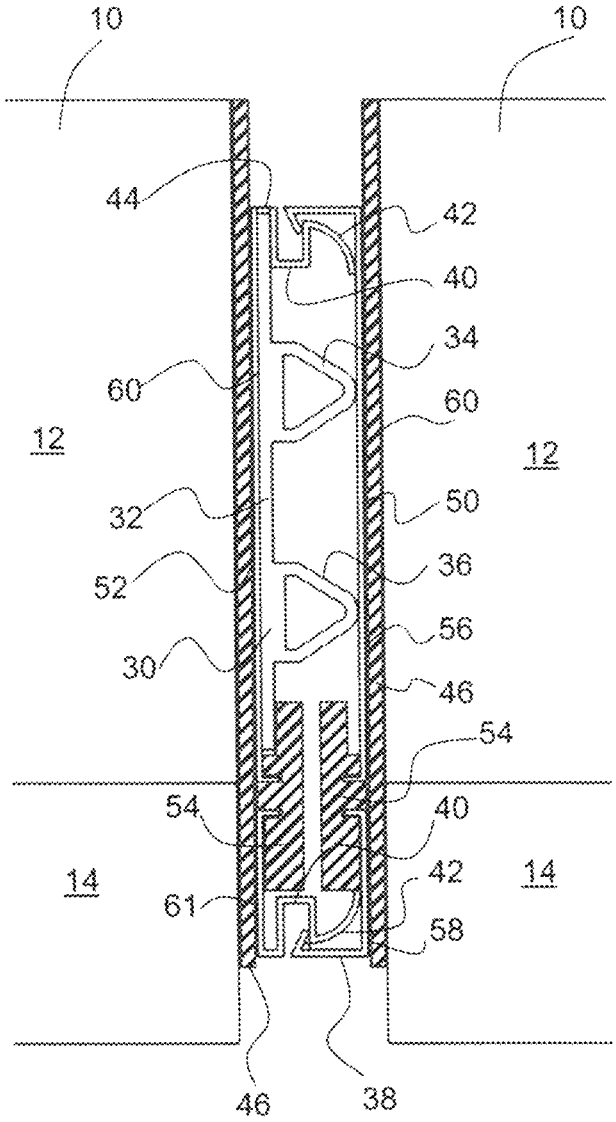
FIG. 4 is a top view of an alternate vertical seal assembly between adjacent exterior wall panels.

In an alternate embodiment is shown in FIG. 4 and has an alternate seal assembly 48 with alternate first 50 and second 52 connectors. Connectors 50 and 52 are each made of two pieces. The two pieces are spaced apart but joined with a connector thermal separator 54. The first connector 50 has a first portion 56 spaced from a second portion 58 joined with a connector thermal separator 54. Second connector 52 has a first portion 60 spaced from a second portion 61 and joined with a connector thermal separator 54.

Figure 5:
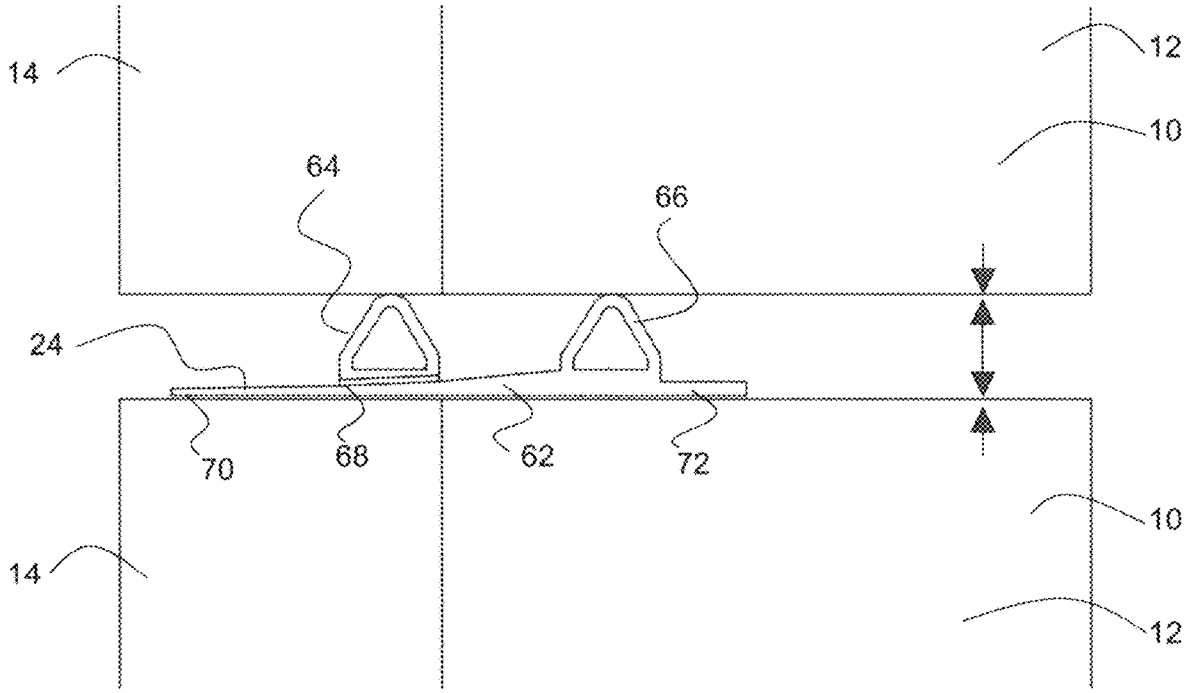
FIG. 5 is side view of a horizontal seal between adjacent exterior wall panels.
Figure 6:
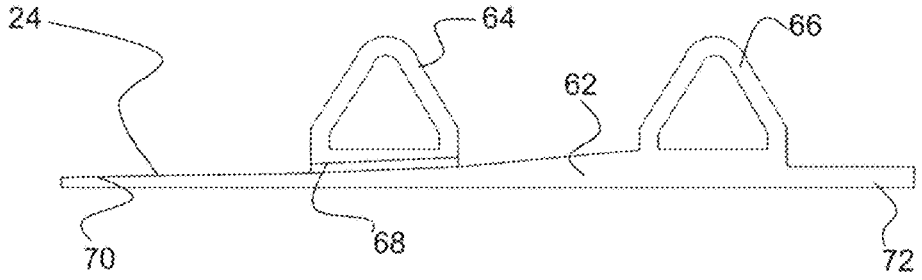
FIG. 6 is a side view of the horizontal seal of FIG. 5.

Referring to FIGS. 5 and 6 a horizontal seal 24 includes a horizontal seal base 62 and at least a first 64 and second 66 upward projections. The horizontal seal base 62 is sloped downwardly so that water will drain away. A drain 68 is formed in the first or forwardmost upward projection 64. In the embodiment shown herein the horizontal seal base 62 includes a front lip 70. The horizontal seal base 62 has a back lip 74.

Figure 7:
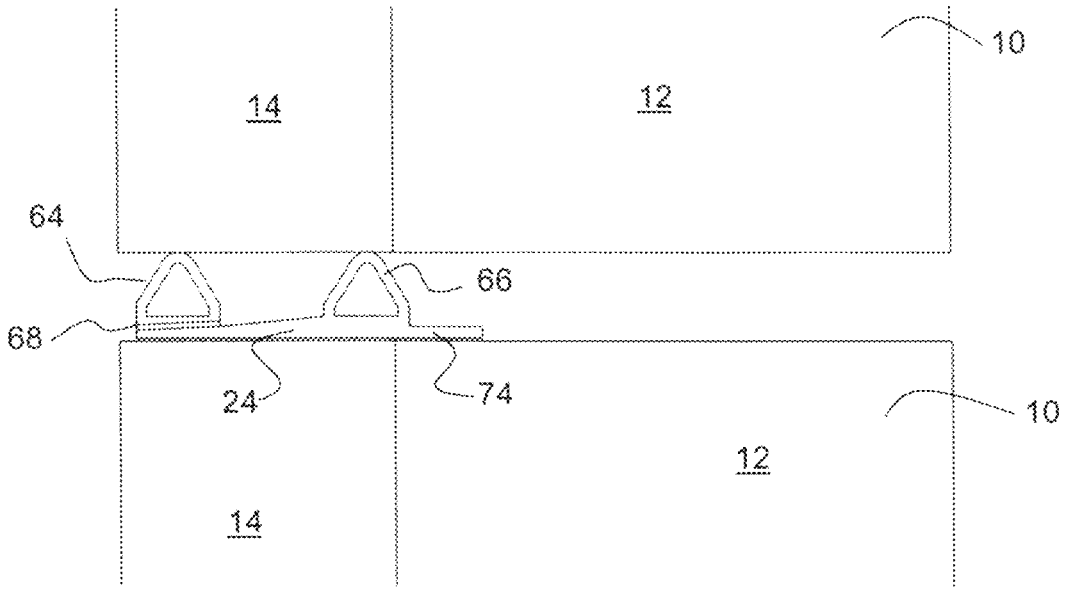
FIG. 7 is side view of an alternate horizontal seal between adjacent exterior wall panels.
Figure 8:
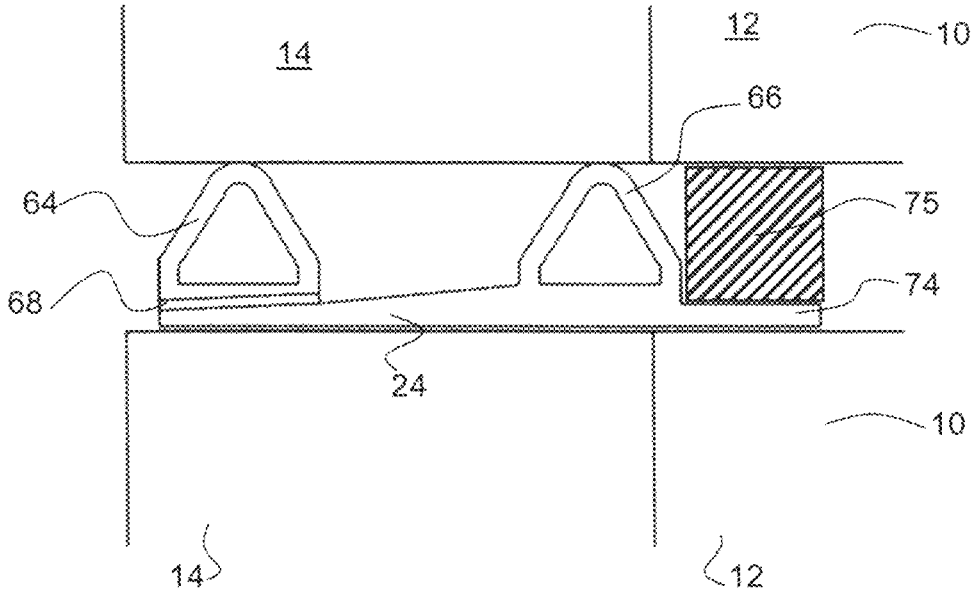
FIG. 8 is a side view of the horizontal seal of FIG. 7.
Figure 9:
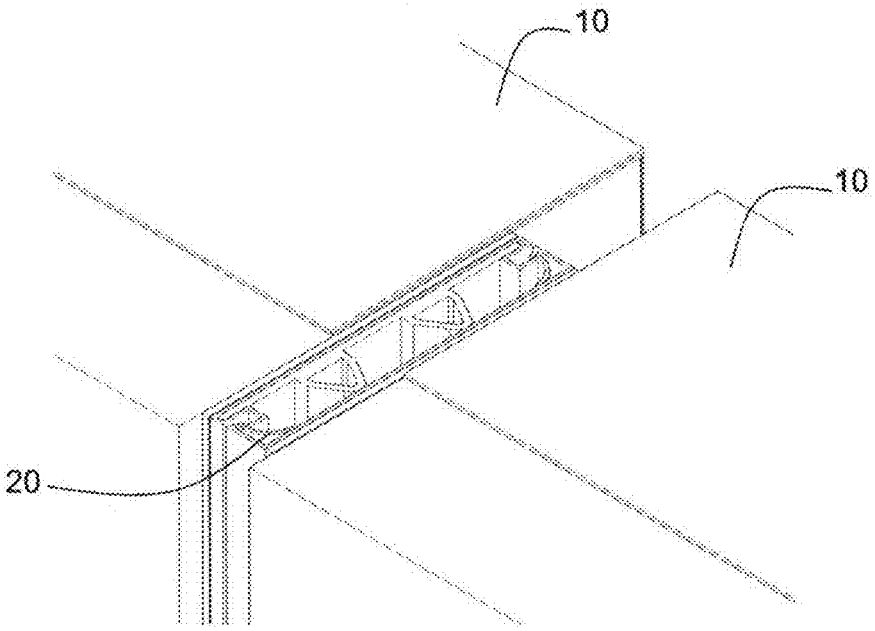
FIG. 9 is a perspective view of the seal assembly of FIG. 3 shown between adjacent exterior panels.

Referring to FIGS. 7 and 8 a horizontal seal 24 includes an alternate horizontal seal base 72 and at least a first 64 and second 66 upward projections. The horizontal seal base 62 is sloped downwardly so that water will drain away. A drain 68 is formed in the first or forwardmost upward projection 64. In the embodiment shown in FIGS. 5 and 6 the horizontal seal base 62 includes a front lip 70.

As can be seen in a comparison between FIGS. 5 and 7 the position of the horizontal seal may vary. As shown in FIG. 5 it may be positioned such that the forwardmost projection 64 is in contact with the exterior insulation portion 14 and the backwardmost projection 66 is in contact with the light steel frame portion. In contrast as shown in FIG. 7 both projections 64 and 66 are in contact with the exterior insulation portion 14. In addition, as shown in FIG. 8 an optional foam seal 75 may also be included. The foam seal 75 may be impregnated with silicone.

Figure 25:
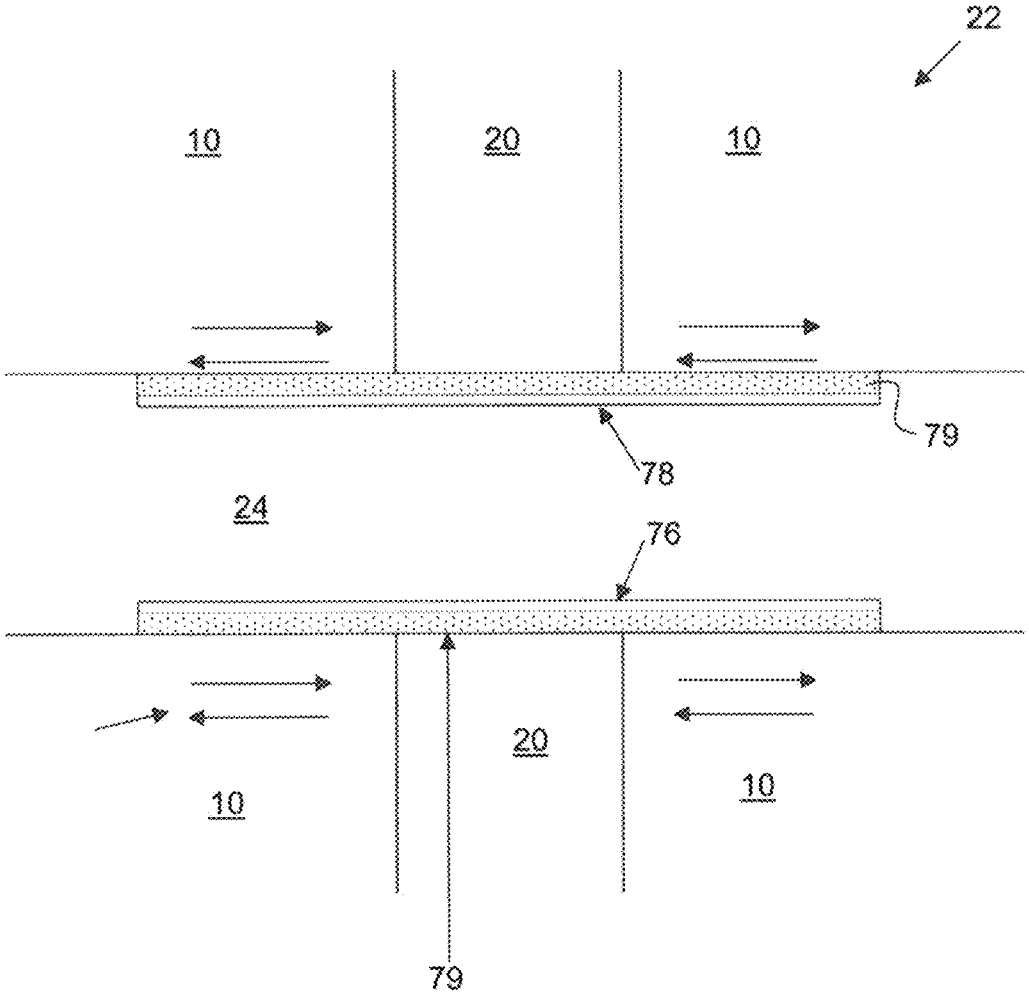
FIG. 25 is a front sectional view of a two upper panels, two lower panels, and the top and bottom chamber plates therebetween of the light weight exterior wall system shown in FIG. 24.

Each vertical seal assembly 20 has a top chamber plate 76 and a bottom chamber plate 78. The top chamber plate 76 includes a plate 80, a front lip 82 and back lip 84 both extending downwardly from the plate 80. The front lip 82 has a drip edge 86 extending downwardly and outwardly from the front lip 82. The bottom chamber plate 78 has a plate 88 and a front lip 90 extending downwardly and a back lip 92 extending upwardly therefrom. The front lip 90 has a drip edge 94 extending downwardly and outwardly therefrom. As shown in FIG. 25 there is a layer of silicone 79 between the exterior insulated panels 10 and top chamber plate 76 and between exterior insulated panels 10 and bottom chamber plate 78. The layer of silicone 79 may be a silicone sheet which is thick enough to be able to be fixed to the bottom chamber plate 78 or top chamber plate 76. The silicone has a ductility that allows lateral shear movement to take place without damage.

Figure 20:
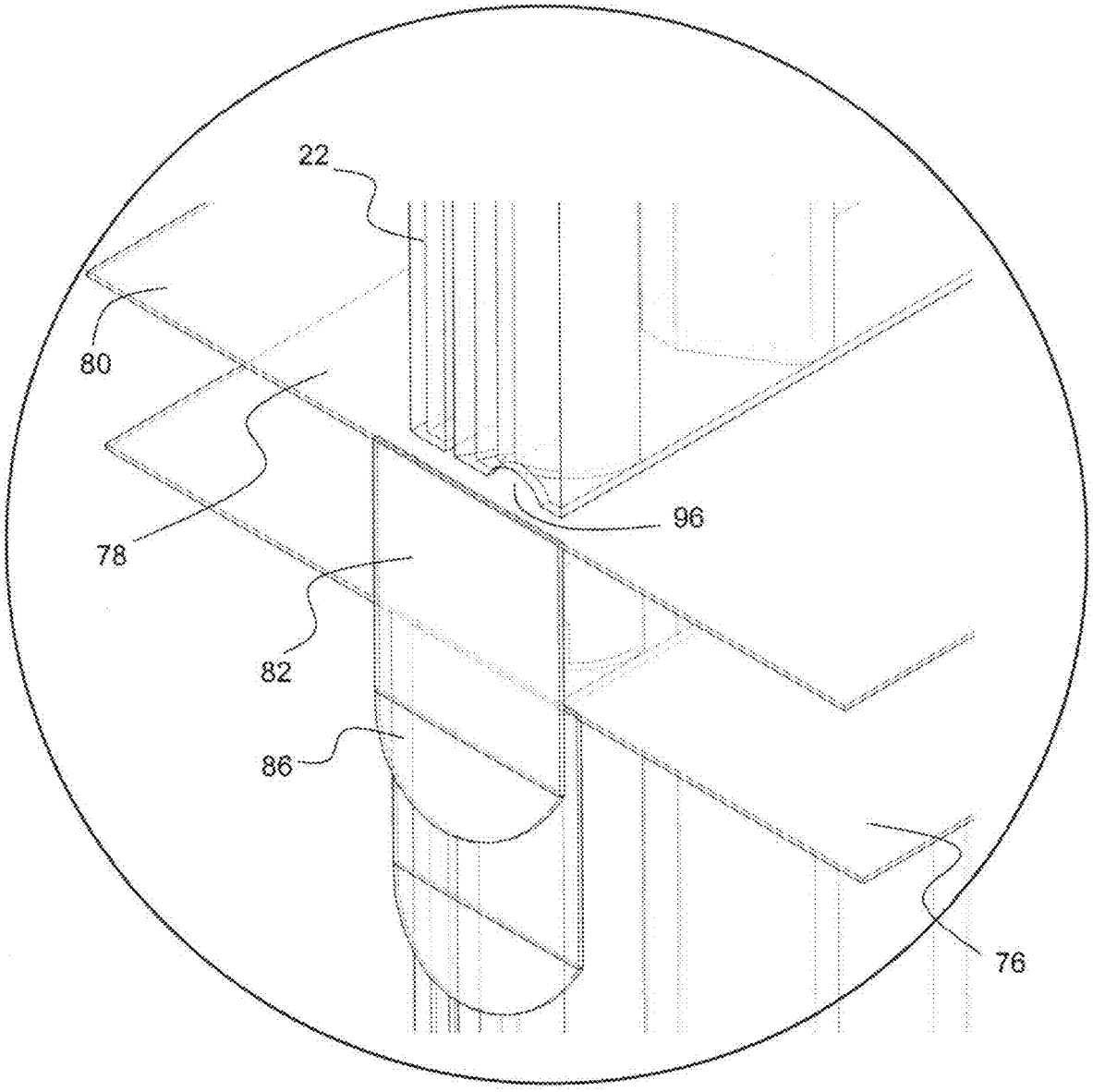
FIG. 20 is an enlarged perspective view a 4-way joint of the exterior wall system.
Figure 21:
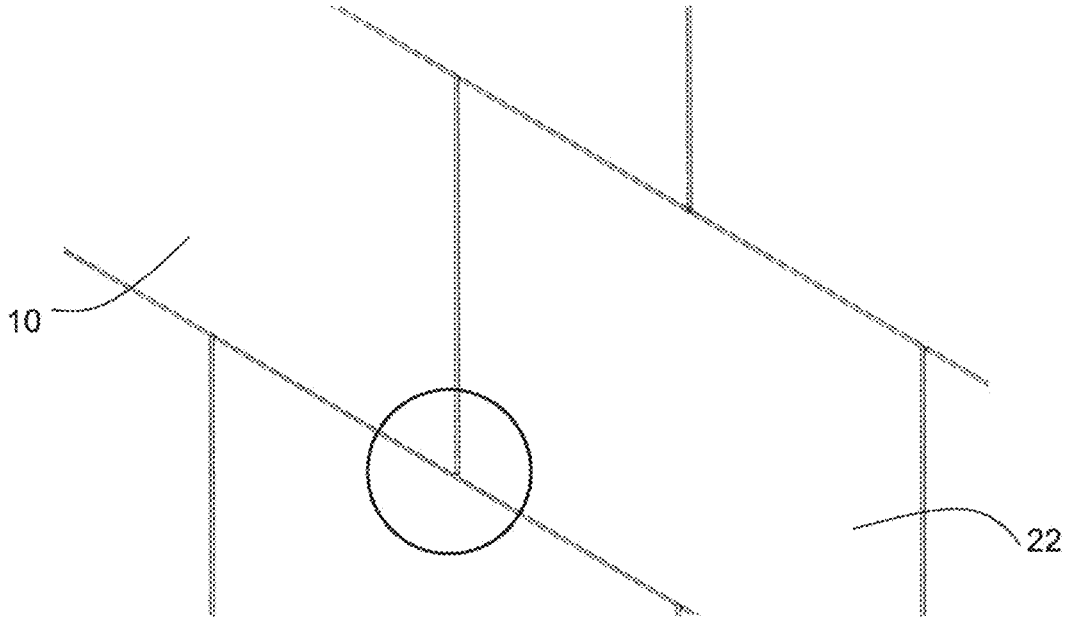
FIG. 21 is a perspective view of an alternate exterior wall system showing 3-way joints.
Figure 22:
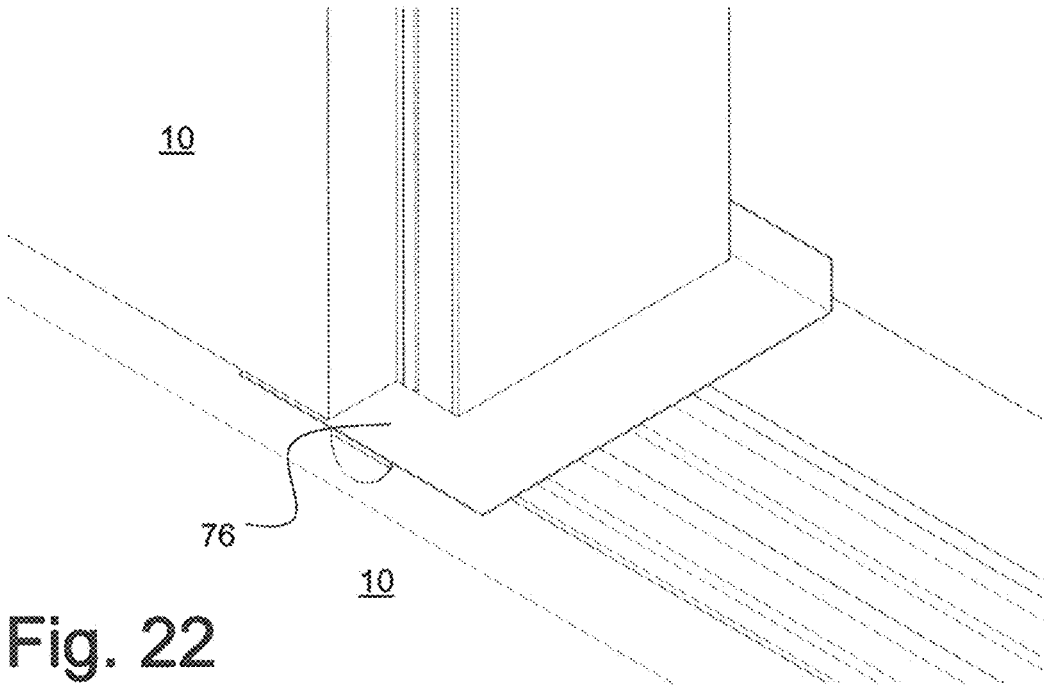
FIG. 22 is an enlarged view of a three-way joint with one exterior panel removed.
Figure 23:
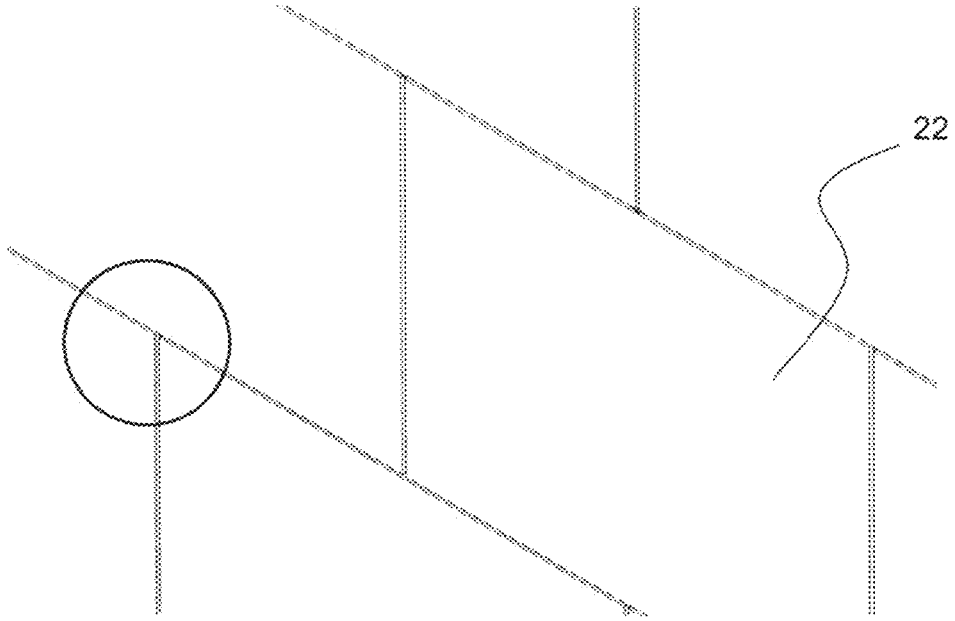
FIG. 23 is a perspective view of the exterior wall system similar that shown in FIG. 21.
Figure 24:
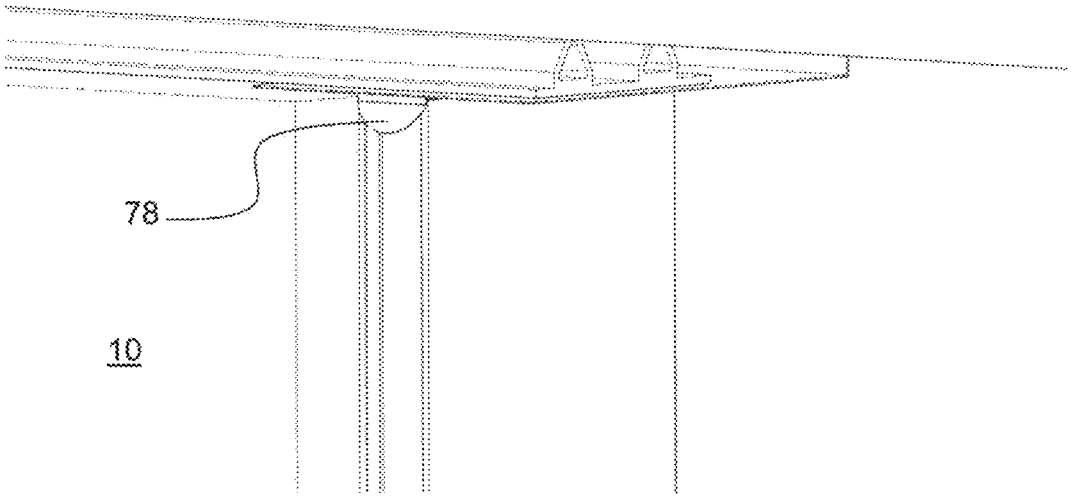
FIG. 24 is an enlarged view of an alternate three-way with one exterior panel removed.

The bottom of each vertical seal assembly 20 has a drainage or weeping hole 96 at the bottom thereof as best seen in FIG. 20. The hole 96 is sized to provide a pressure equalization chamber under the rain screen principle.

The exterior wall system 22 provides a panel joint seal system for curtain wall panels 10 that are framed with light steel members 12 and are insulated 14 outside of the framing. The exterior wall system 22 relates to curtain wall construction, and more particularly, a curtain wall construction made up of cold-formed steel structure 12 that has an exterior insulation system incorporated 14. The exterior wall system 22 provides a dry seal system around the periphery of the exterior insulated wall panels for building construction. The seal system incorporates the rain screen principle to reduce the demand on the seals, this reduces demand on the seal system as wind pressurizes the chamber between the outer and inner seals.

The seals are silicone or rubber, extruded into a shape that allows inherent movements to take place and resist entry of moisture and air into the building. Consideration is given to ensure the seal material maintains flexibility in hot and cold weather. The joint system is thermally efficient, there is substantially little to no thermal bridging in this new joint invention.

Ideally panels 10 are erected one complete floor level at a time. The roll-formed shape of this invention facilitates the connection between two horizontally adjacent panels 10, this allows for the vertical joints of the panels to be snapped together, then lowered into place.

The vertical seal assembly 20 incorporates a means of movement between the panels vertically and horizontally to accommodate structural and thermal changes in the panel and building structures. The roll-formed shape of the connectors 26, 28 and its double vertical seal 30 allow for horizontal movements of +/−⅛". The Seal system along the horizontal joint allows for +/−⅝".

A vertical seal assembly 20 includes a cold formed shaped first 26 and second 28 connectors. One of the first 26 and second 28 connector incorporates a flexible double seal component 30 and rain screen protection for the seals. The formed shape also incorporates the snap together mechanism for optimization of panel erection.

Figure 10:
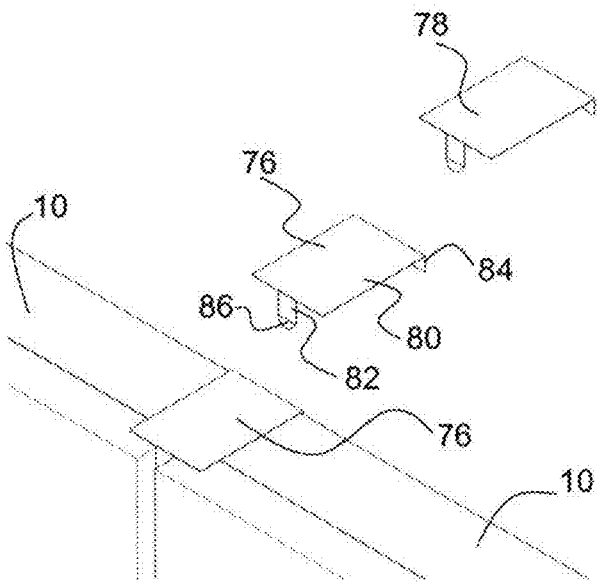
FIG. 10 is a perspective view of a top chamber plate and showing the top chamber plate in situ over the seal assembly shown in FIG. 9.
Figure 11B:
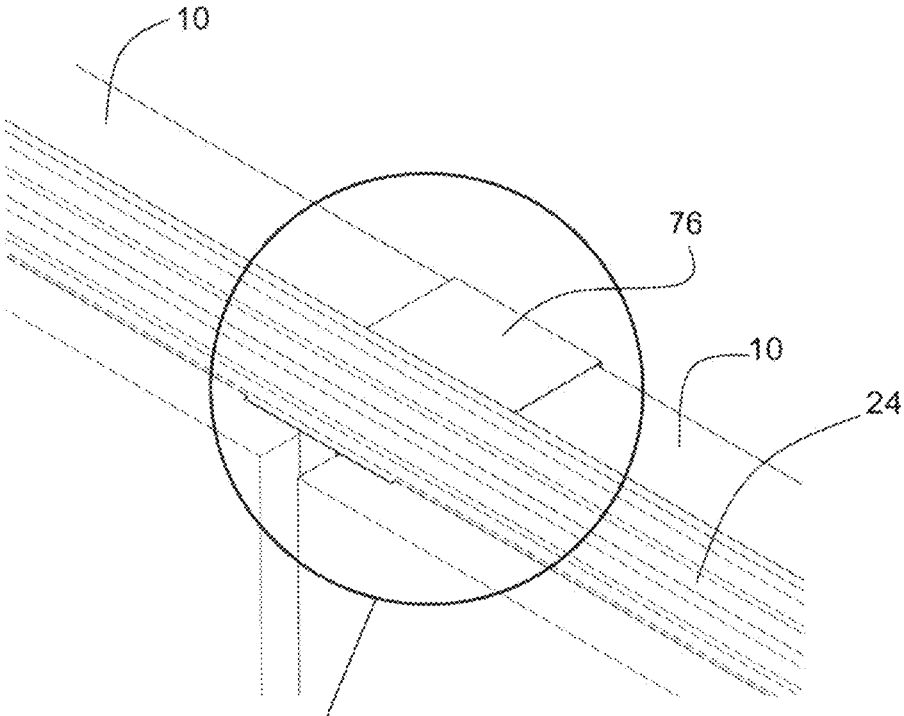
FIG. 11B is an enlarged perspective view of the top of one of the exterior panel joints and showing a horizontal seal.
Figure 11A:
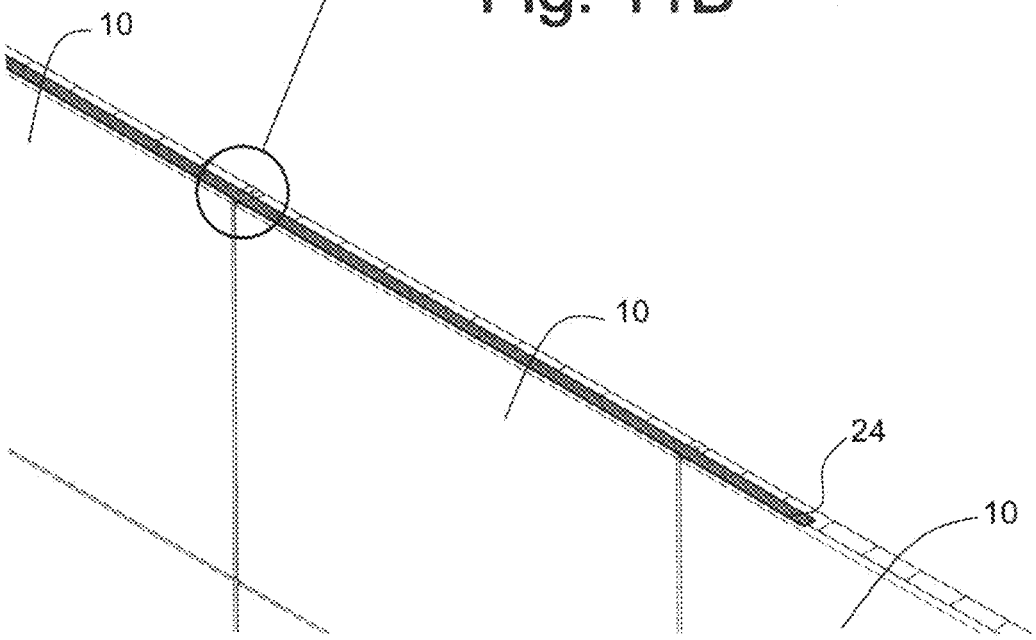
FIG. 11A is a perspective view of an exterior wall system showing the top of a plurality of wall panels.

At the horizontal joints between adjoining panels a four way top chamber plate 76 is buttered (FIG. 10) to the top of the vertical seal assembly. The top chamber plate 76 when buttered into place becomes the top of the pressure equalization chamber. A horizontal double seal element 24 is then buttered to the top surface of the lower panels 10, continuous over the properly buttered in place top chamber plates 76. Care must be taken to assure that the horizontal double seal is spliced away from the 4-way joint, preferably the splices are centered between the 4-way joints, this simplifies the 4-way joint and enhances the way the seal and drainage system works.

The horizontal double seal is spliced to incorporate a drainage system, this provides a rain screen. There are a variety of ways to provide a sufficient joint. A simple butter and flat material can be incorporated to splice the seals.

A splice node with a drainage-cavity can be used to splice the horizontal double seal in order to incorporate the rain screen principle for the horizontal seal system.

For some uses a particular surface treatment can be applied to the underside surface of each panel in order interact with the functionality and movements of the horizontal double seal.

An alternate exterior wall system 22 is shown in FIGS. 26 to 41 and is similar that shown in FIGS. 1 to 25 but showing some variations to the vertical seal 20 and the horizontal seal 24. However most of the features and the use are similar to that shown and discussed above.

Figure 26:
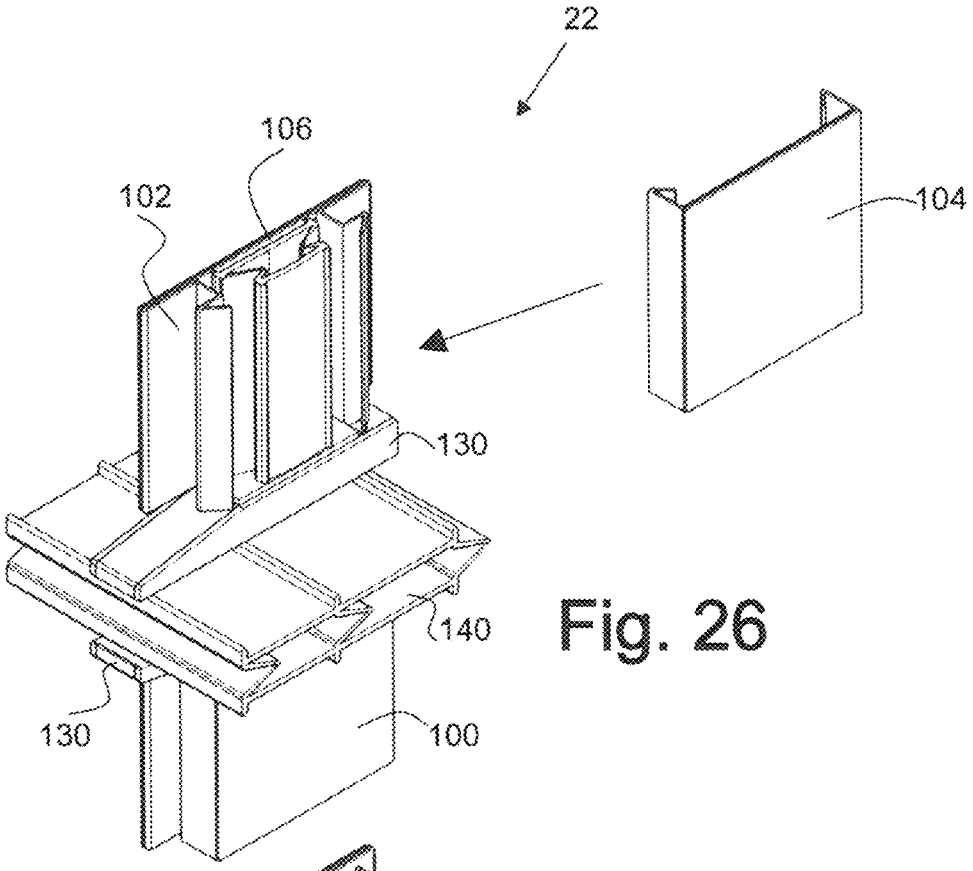
FIG. 26 is a blown apart perspective view of an alternate embodiment of a seal assembly for use in a light weight exterior wall system.
Figure 27:
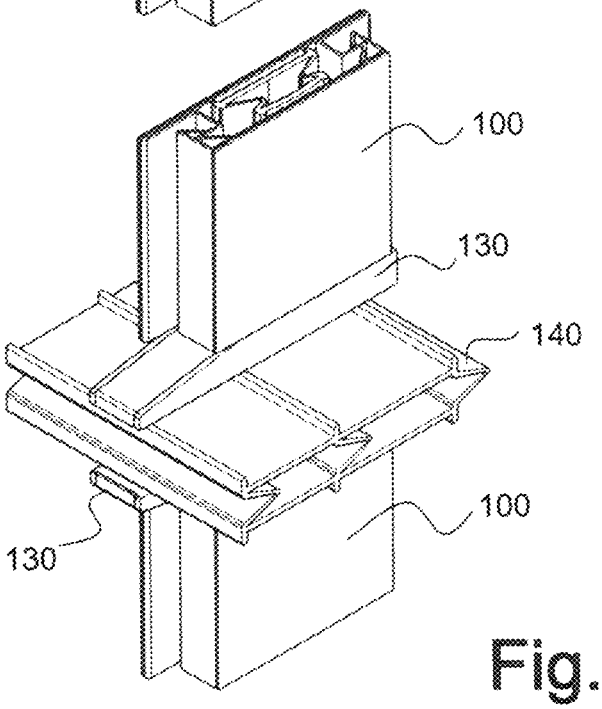
FIG. 27 is a perspective view of the assembled seal assembly of FIG. 26.
Figure 28:
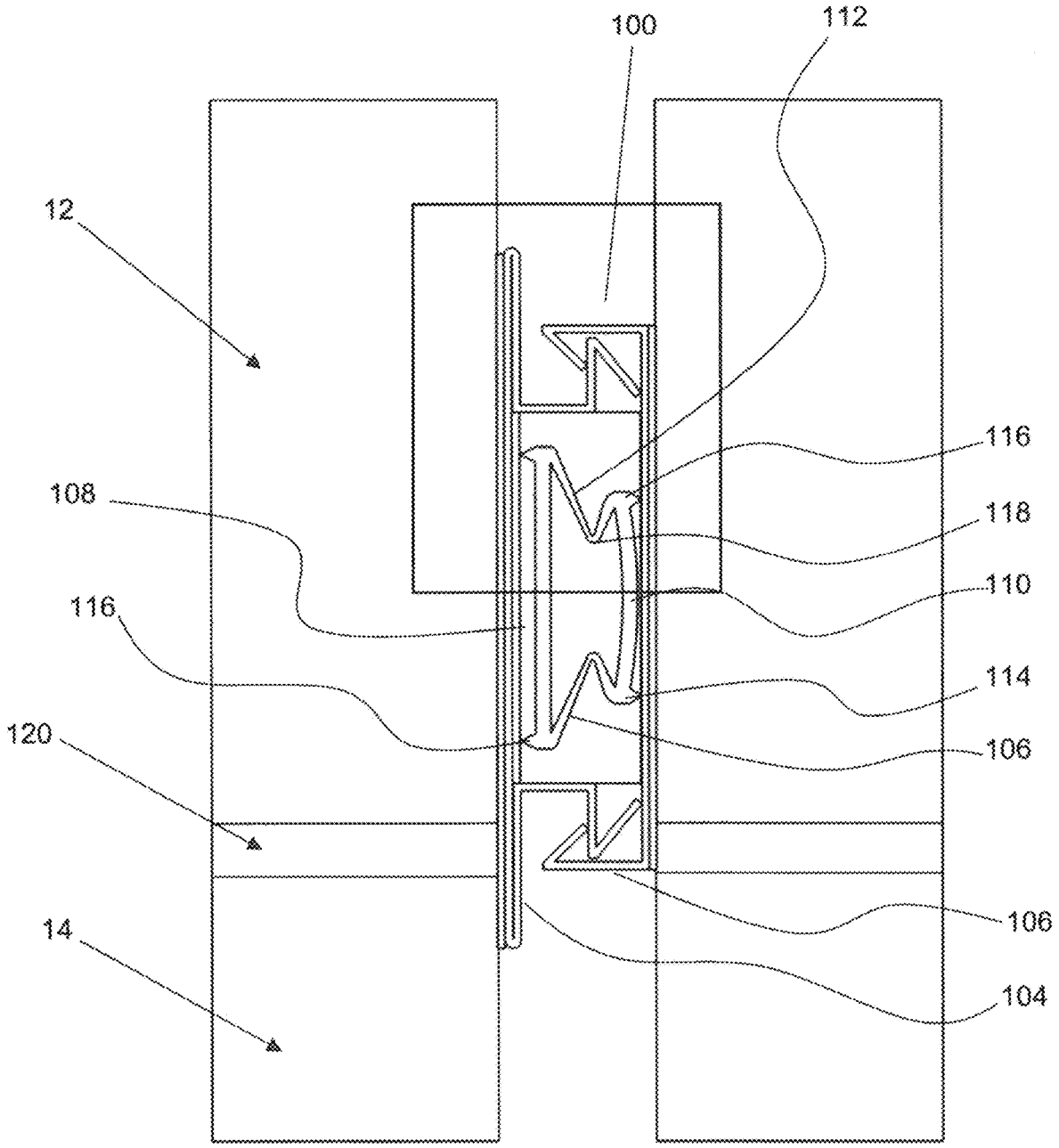
FIG. 28 is a top sectional view of the seal assembly of FIGS. 26 and 27.

Referring to FIGS. 26-28 an alternate vertical seal assembly is shown generally at 100. Vertical seal assembly 100 includes a first vertical connector 102, a second vertical connector 104 and a vertical seal 106. As shown herein first vertical connector 102 is a male connector and second vertical connector 104 is a female connector. First and second vertical connectors are made from cold rolled steel.

The vertical seal 106 is made of resilient deformable material such that the seal has a memory of the original shape. The vertical seal 106 has a pair of opposed sides 108 and 110 and a pair of opposed sides 112 and 114 extending between sides 108 and 110. Sides 106 and 108 have little feet 116 extending outwardly at each end thereof. Side 108 is longer than side 106. Opposed sides 112 and 114, each have a bend 118 therein to make it easier for the sides 106 and 108 to be pushed closer under pressure. Bend 118 is resilient to facilitate opposed sides 106 and 108 to be pushed closer under pressure. Vertical seal 106 is positioned between first vertical seal connector 102 and second vertical seal connector when they are engaged. Feet 116 extending from sides 108 and 110 engage vertical seal connectors 102 and 104. When in position typically sides 112 and 114 will be bent inwardly from their original position so that the seal is pushing outwardly to form a good seal with the vertical seal connectors 102 and 104.

In the embodiment shown in FIG. 28 the wall panel 10 includes a light steel frame portion 12, an exterior insulation portion 14 and gypsum sheathing 120 therebetween. It will be appreciated by those skilled in the art that the exterior wall system 22 herein can be used with a number of different types of wall panels.

Figure 29:
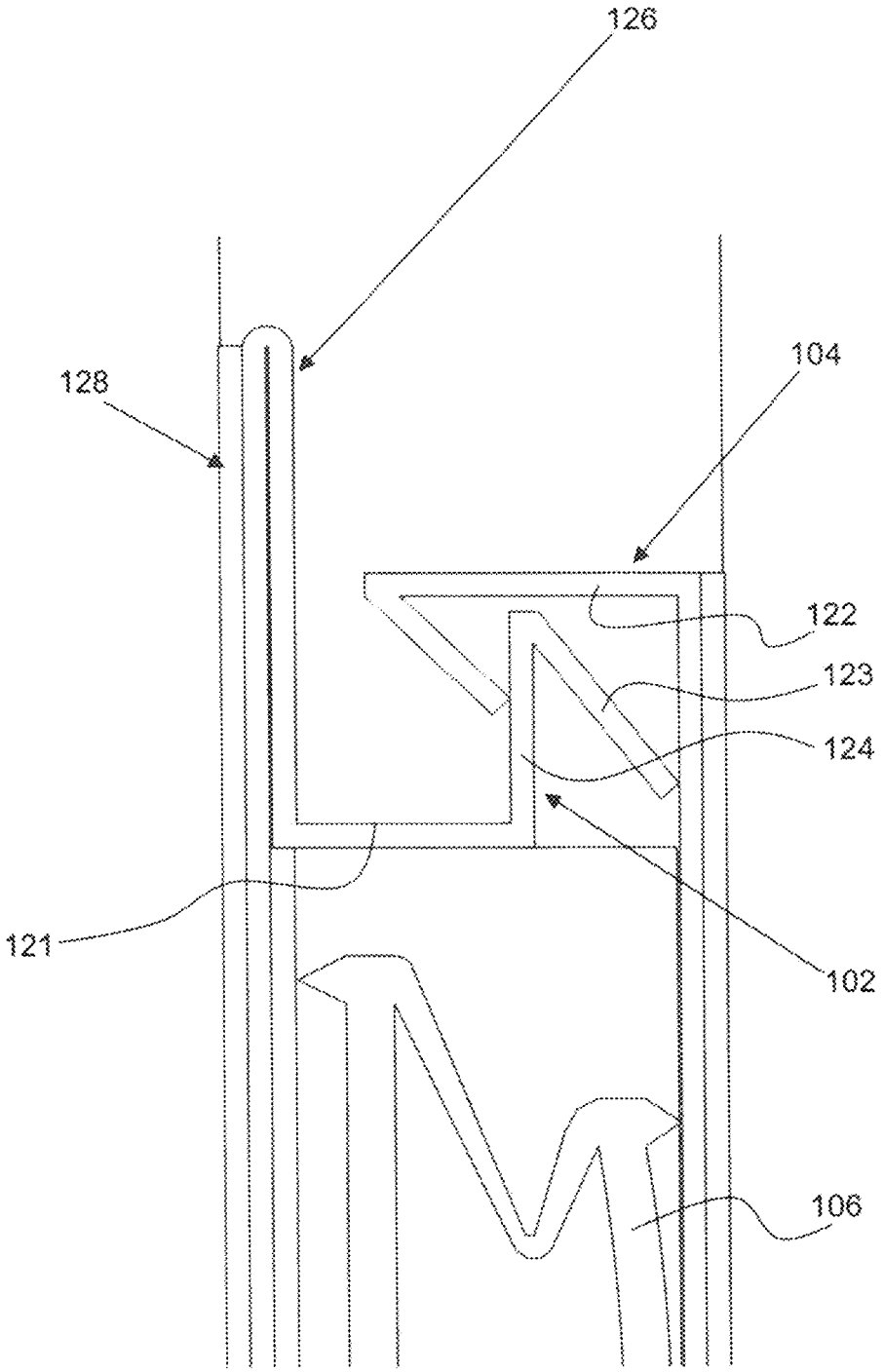
FIG. 29 is an enlarged top sectional view of the connection between the first connector and the second connector of the seal assembly of FIG. 28.

Referring to FIG. 29 the female connector 104 has a hook portion 122 and the male connector 102 has an engagement portion 124 for connecting with the hook portion 122. The engagement portion 124 includes a channel 121 and a guide 123. The male connector 102 includes a leg extension portion 126 that extends outwardly from the channel 121. The leg extension portion 126 in position protects the exterior insulation portion 14 and the gypsum sheathing 120 is present when the female connector 104 is angled into position.

A pair of thermal separators 128 are positioned between the first 102 and second 104 connectors and the exterior insulated panels 10.

Figure 30:
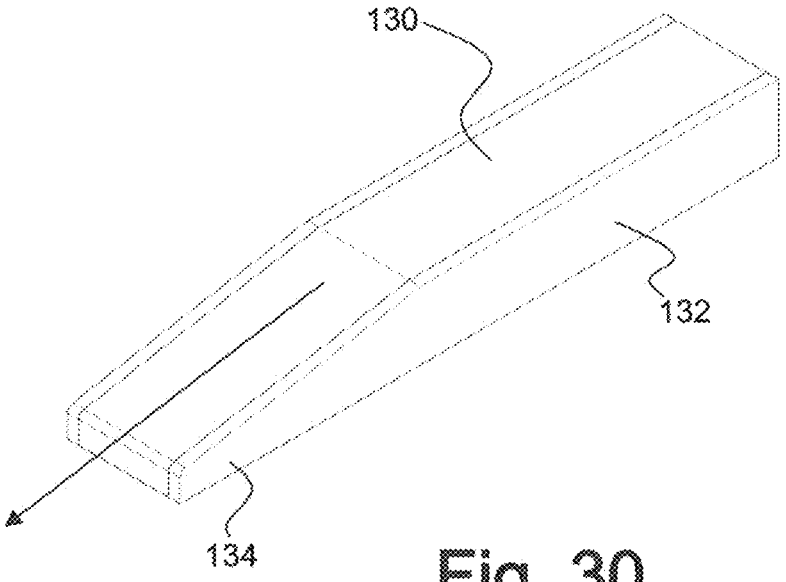
FIG. 30 is a perspective view of a plug in a bottom orientation for use in the light weight exterior wall system.
Figure 31:
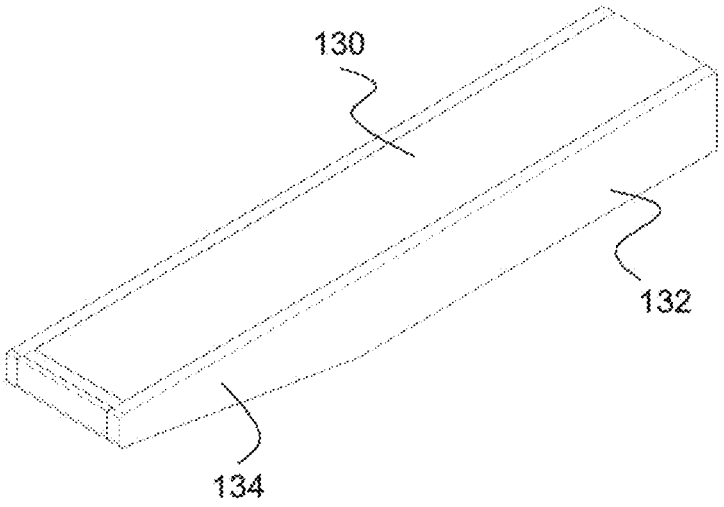
FIG. 31 is a perspective view of the plug of FIG. 30 but shown in figure top orientation.

Referring to FIGS. 30 and 31 a plug is shown generally at 130. In FIG. 30 the orientation of the plug is shown as it would be positioned at the bottom of a vertical seal assembly 100 and FIG. 31 shows the orientation of the plug 130 at the top of the vertical seal assembly 100. Plug 130 is dimensioned to fit between wall panels below and above the vertical seal 100 as can be seen in FIGS. 26 and 27. Plug 130 includes a body portion 132 and a sloped portion 134. The sloped portion 134 allows for drainage and air circulation. The vertical seal assemblies 100 include a vertical seal boot 136 inside the top and the bottom thereof as shown in FIG. 32.

Figure 32:
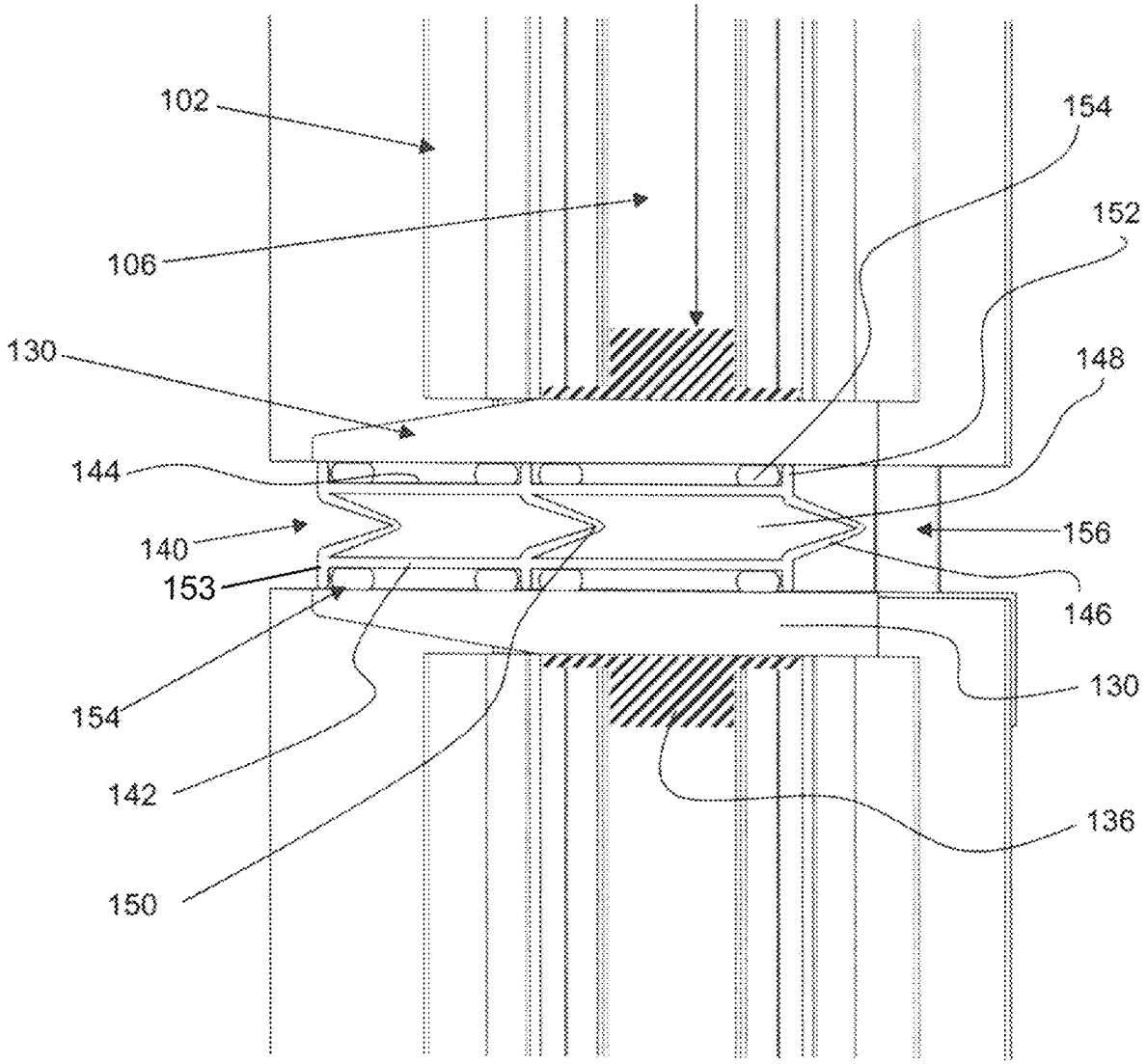
FIG. 32 is a side sectional view of a horizontal seal between adjacent exterior wall panels.
Figure 33:
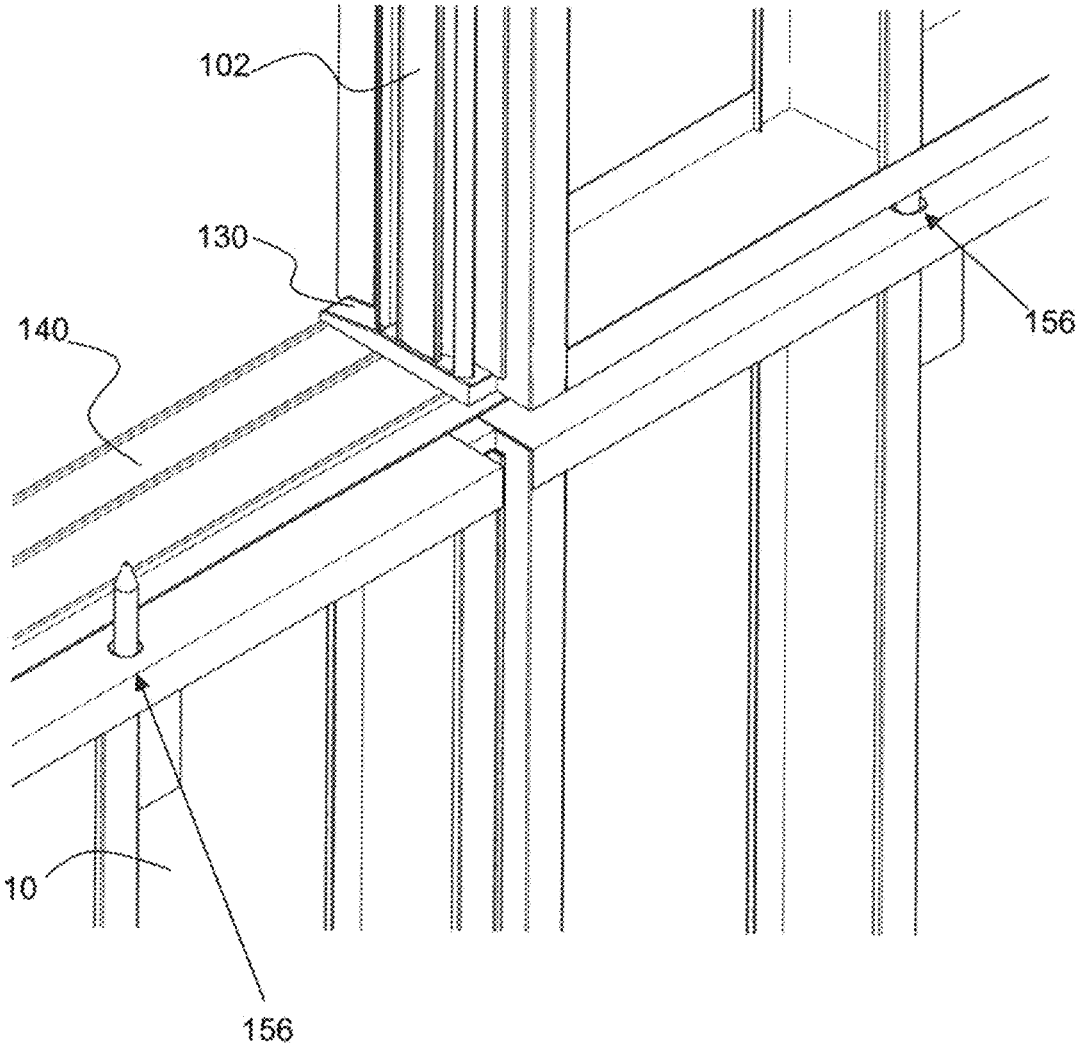
FIG. 33 is a front perspective view of the light weight exterior wall system and showing an alignment pin.
Figure 34:
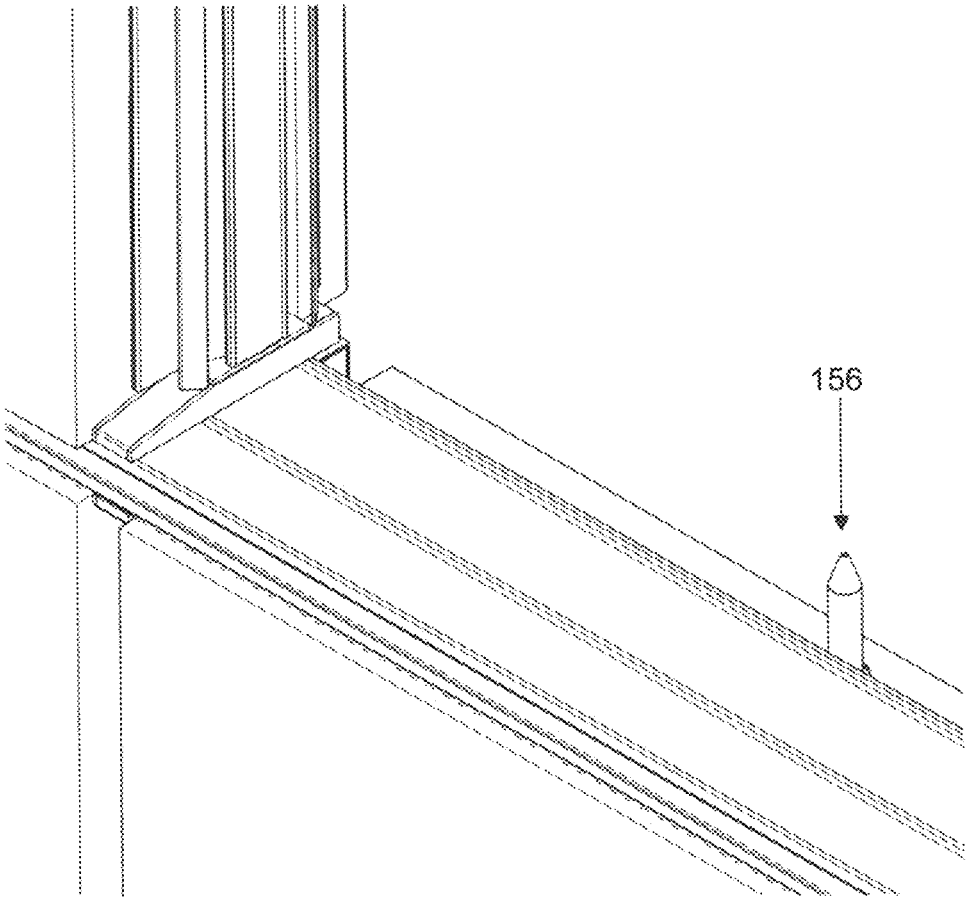
FIG. 34 is a back perspective view of the light weight exterior wall system and showing alignment pins.

An alternate horizontal seal 140 is shown in FIGS. 26, 27 and 32. The details of the horizontal seal 140 are discussed with reference to FIG. 32. Horizontal seal 140 includes has a base 142 and a top 144 and three walls 146 extending therebetween thus forming two chambers 148. The base 142 is spaced apart from the top 144. The three walls 146 are spaced apart from each other. The three walls include an exterior wall, an interior wall and a chamber wall. Horizontal seal 140 is made of resilient deformable material such that the seal 140 has a memory of the original shape. Walls 146 have bends 150 therein to facilitate the movement of the base 142 and top 144 relative to each other. The base 142 and top 144 have a pair of spaced apart top feet 152 extending upwardly and a pair of spaced apart base feet 153 extending downwardly in line with the walls 146. Feet provide guides for the caulking 154. Caulking 154 is positioned proximate to the feet 152. The horizontal seal 140 is designed to extend along the top of exterior panel 10 and to provide a seal between vertically adjacent panels as best seen in FIG. 33.

Referring to FIGS. 30 to 32, a positioning pin 156 helps to position adjacent panels 10. The positioning pin 156 extends upwardly from a lower panel and helps to align an upper panel when it is lowered into place. It will be appreciated by those skilled in the art that the exterior wall system described herein may include a plurality of positioning pins 156 wherein all of the vertically adjacent wall panels 10 may have positioning pins 156 therebetween.

Figure 35:
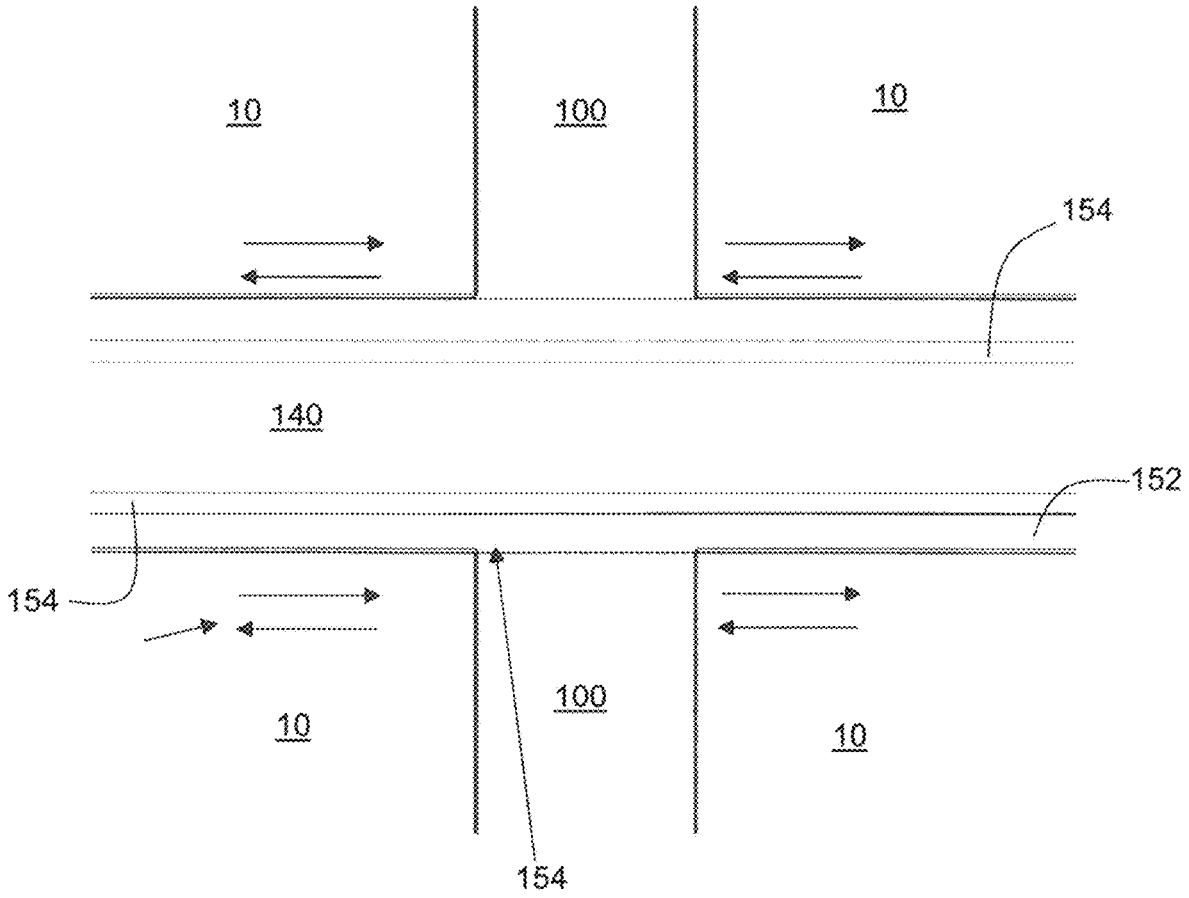
FIG. 35 is a front sectional view of a two upper panels, two lower panels, and the top and including the horizontal seal of FIG. 32, 37, 39 or 41 therebetween by way of example.

Referring to FIG. 35, the horizontal arrows 158 show the potential shear movement of the panels 10.

Figure 36:
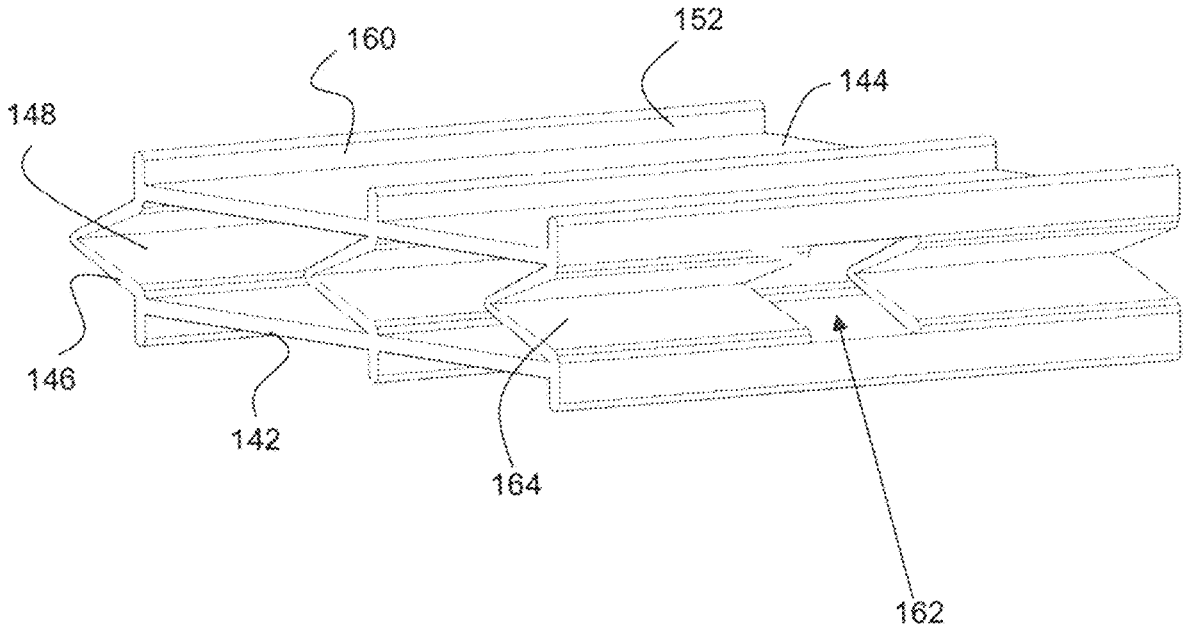
FIG. 36 is an enlarged perspective view of the horizontal seal shown in FIGS. 26, 27 and 32 but showing an optional pressure equalization hole.

Referring to FIG. 36 another alternate horizontal seal 160 is similar to horizontal seal 140 but it further includes a hole 162 in the outermost wall 164. Hole 162 provide drainage and pressure equalization.

Figure 37:
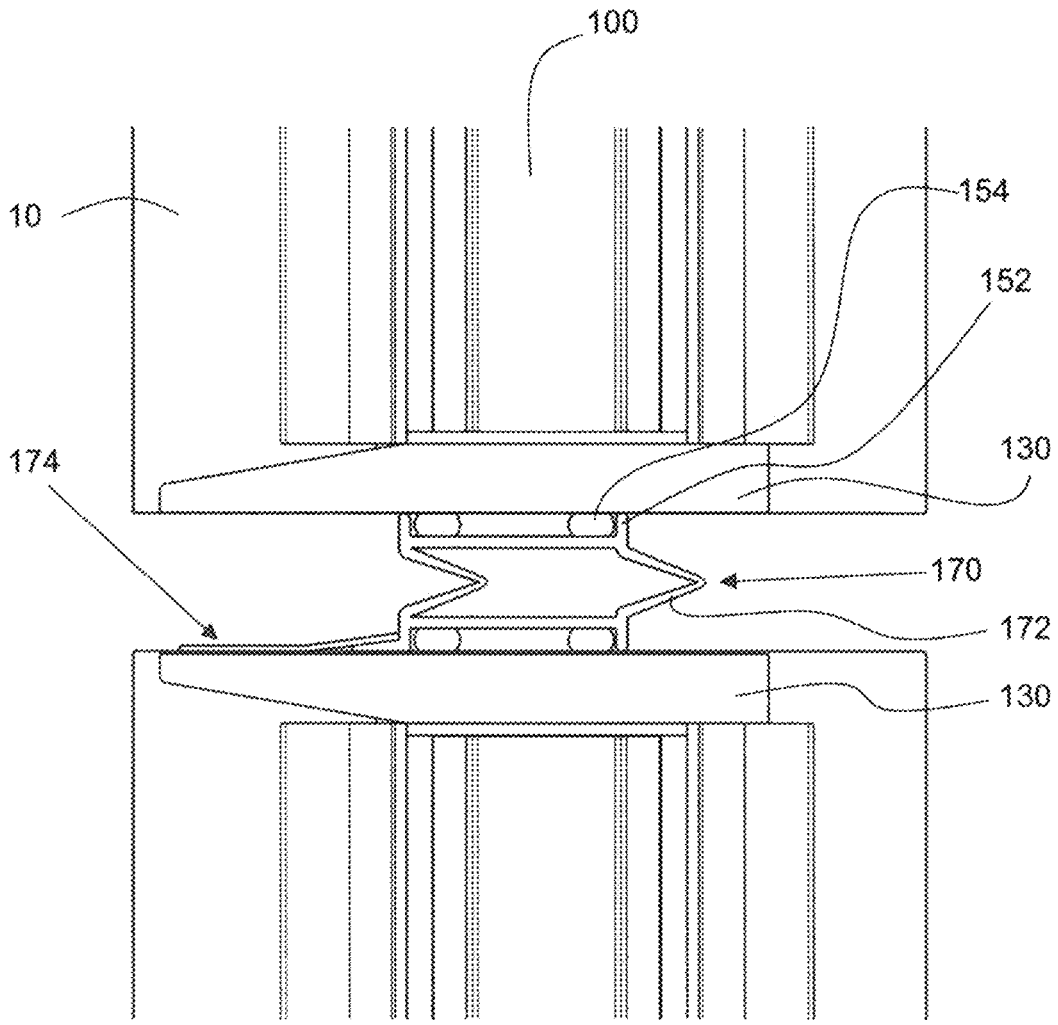
FIG. 37 is a side sectional view similar to that of FIG. 32 but showing an alternate horizontal seal between adjacent exterior wall panels.
Figure 38:
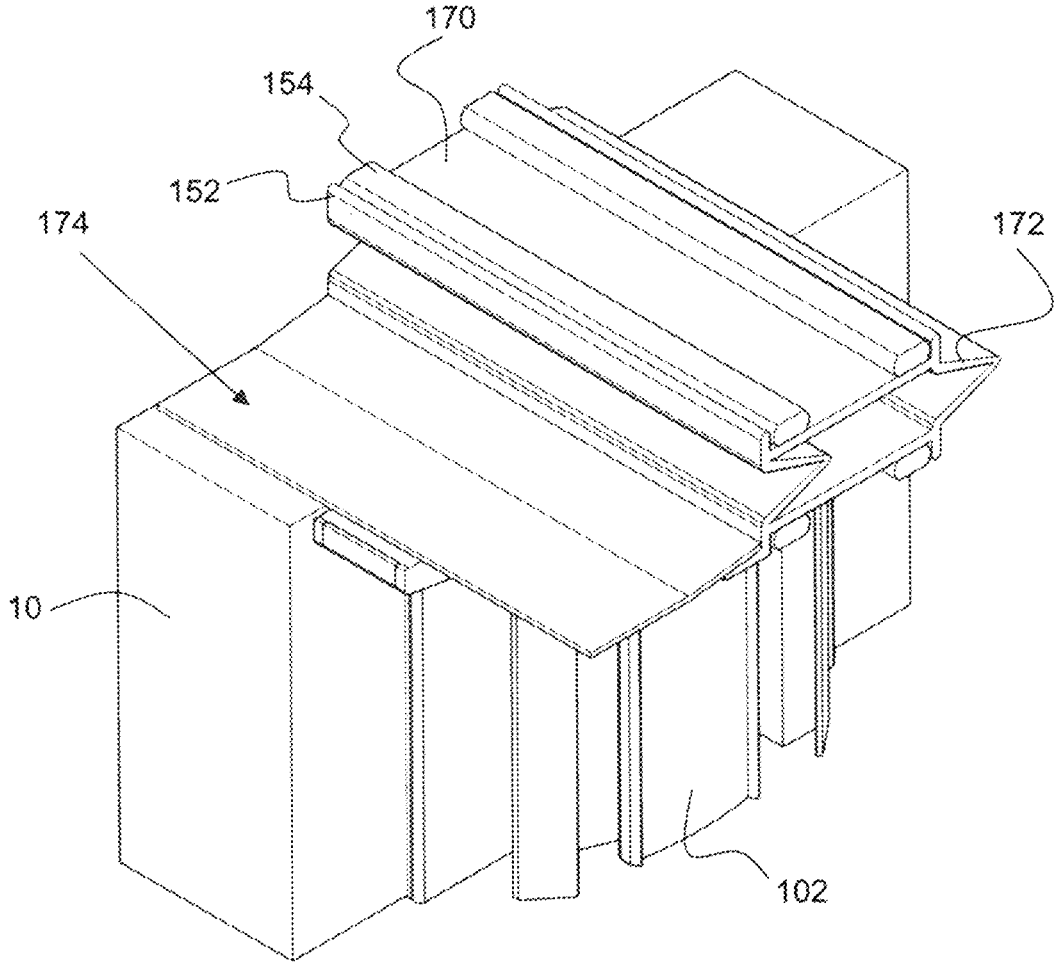
FIG. 38 is a top perspective view of the horizontal seal shown in FIG. 37.

Another alternate horizontal seal 170 is shown in FIGS. 37 and 38. Horizontal seal 170 is similar to horizontal seal 140 but it only includes two walls 172. It also includes a front extension 174. Front extension 174 is dimensioned to protect the waterproofing material on the front of panel 10. The feet 152 and caulking 154 are as described above.

Figure 39:
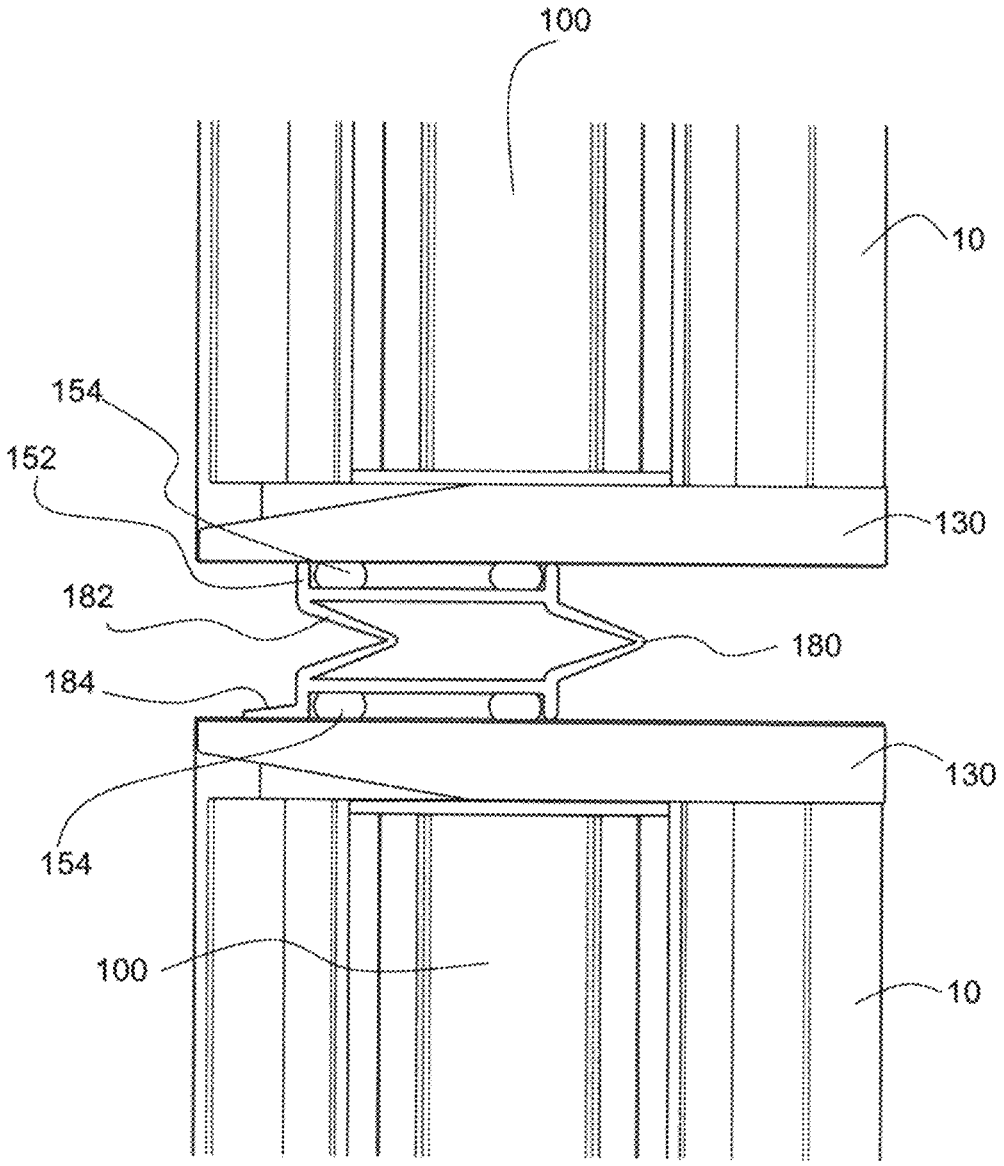
FIG. 39 is side perspective sectional view similar to those of FIGS. 37 and 38 but showing another alternative horizontal seal between adjacent exterior wall panels.
Figure 40:
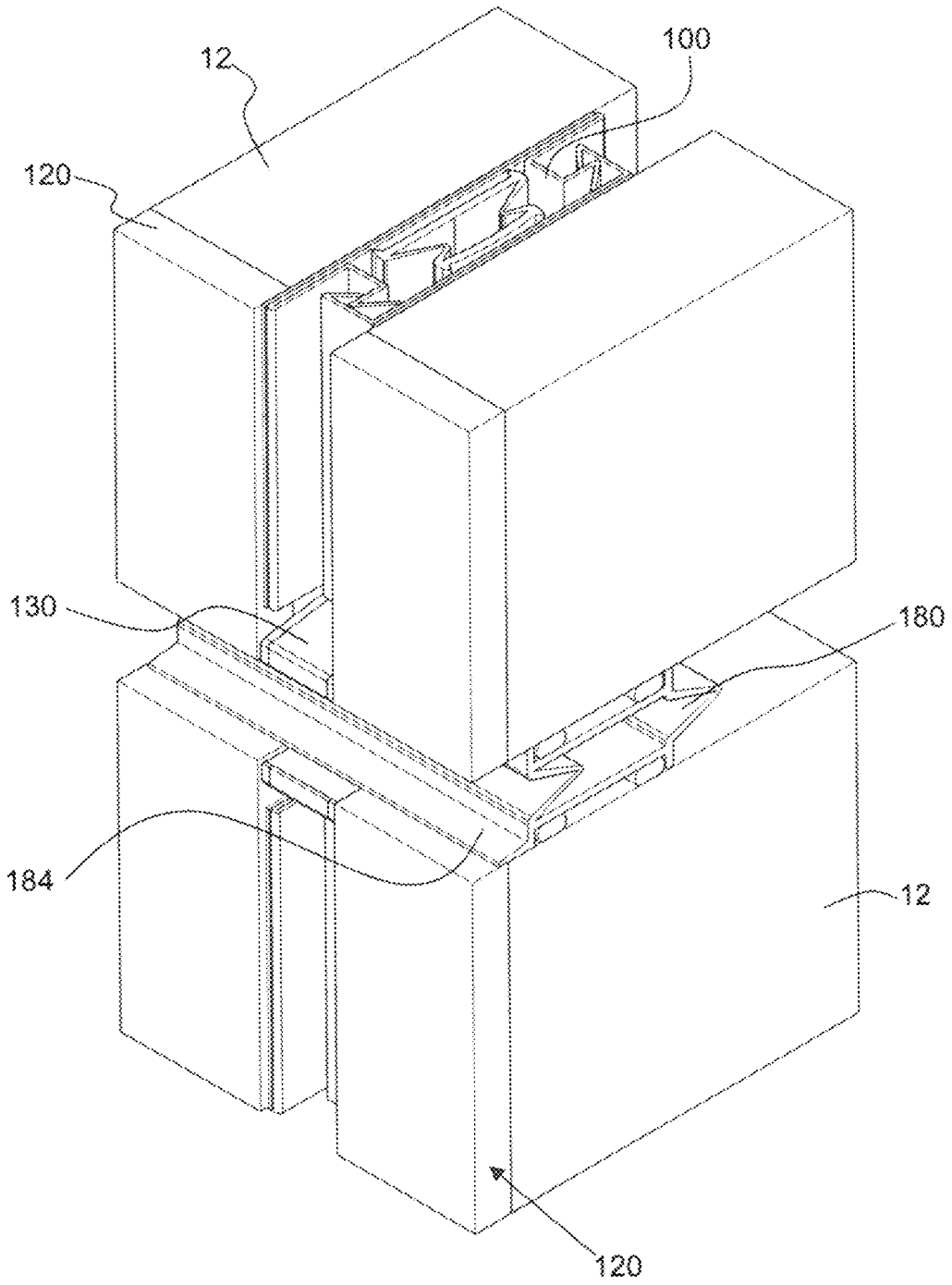
FIG. 40 is a perspective view of the horizontal seal of FIG. 39 in use in a light weight exterior wall system.

Another alternate horizontal seal 180 is shown in FIGS. 39 and 40. Horizontal seal 180 is similar to horizontal seals 140 but it only includes two walls 182 similar to horizontal seal 170. Horizontal seal 180 includes a front lip 184. Horizontal seal 180 would typically be used when the wall panel 10 is a non-insulated panel or when used with a gypsum board as shown in FIG. 40. The feet 152 and caulking 154 are as described above.

Figure 41:
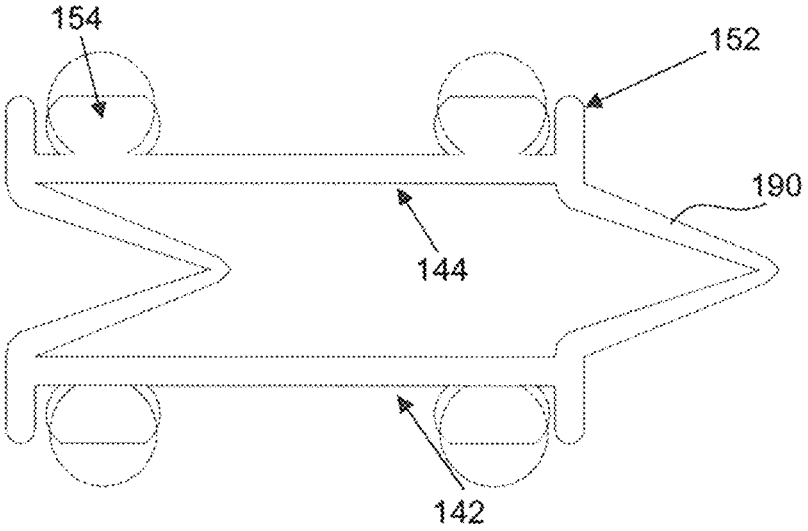
FIG. 41 is an enlarged sectional view of the horizontal seal similar to that of FIG. 39.

A sample horizontal seal 190 is shown in FIG. 41 to show the deformation of the caulking 154. The feet 152 define the final height of the caulking. The dotted lines 192 show the starting shape of the caulking before it is positioned between the panels and it is deformed to form a resilient seal between adjacent vertical panels. Generally speaking, the systems described herein are directed to wall panel systems and seal assemblies. Various embodiments and aspects of the disclosure are described in the detailed description. The description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

What is claimed is:

1. A horizontal seal for use with horizontally adjacent exterior wall insulated panels, comprising:

a base having at least a pair of spaced apart base feet extending downwardly therefrom;

a top spaced apart from the base and having at least a pair of spaced apart top feet extending upwardly therefrom;

an exterior wall extending between the base and the top and the exterior wall has a bend therein;

an interior wall extending between the base and the top and the interior wall has a bend therein;

wherein the base, the top, the exterior wall and the interior wall define a tubular member and wherein the bend in the exterior wall and the bend in the interior wall facilitates movement of the base relative to the top.

2. The horizontal seal of claim 1 wherein the base feet are aligned with the exterior wall and the interior wall.

3. The horizontal seal of claim 2 wherein the top feet are aligned with the exterior wall and the interior wall.

4. The horizontal seal of claim 1 further including a chamber wall positioned between the exterior wall and the interior wall and extending between the base and the top, thereby forming two chambers.

5. The horizontal seal of claim 1 further including a plurality of chamber walls positioned between the exterior wall and the interior wall and extending between the base and the top, thereby forming a plurality of chambers.

6. The horizontal seal of claim 1, wherein a horizontal exterior face of the horizontal seal has at least one hole formed therein to provide pressure equalization for the horizontal seal.

7. The horizontal seal of claim 1, wherein the horizontal seal includes a front extension.

8. The horizontal seal of claim 1, wherein the horizontal seal includes a front lip.

9. An exterior wall system comprising:

a plurality of wall exterior insulated panels;

a plurality of seal assemblies connected between horizontally adjacent exterior insulated panels wherein each seal assembly includes a first connector being attached to one of first and second exterior insulated panels;

a second connector being attached to the other of the first and second exterior panels;

a vertical seal being attached to one of the first and second connectors; and wherein the first and second connectors are configured to be connected together such that the first and second exterior insulated panels are horizontally adjacent so as to connect and seal horizontally adjacent exterior insulated panels; and at least two horizontal seals between vertically adjacent exterior insulated panels, wherein each horizontal seal is as defined in claim 1.

10. The exterior wall system of claim 9 wherein at least four wall exterior insulated panels are arranged to form a 4-way joint and wherein plates are buttered with silicone and installed to the top and bottom of the seal assembly to span horizontally across the 4-way joint above and below the horizontal seal, thereby providing a continuous sealing surface for the horizontal seals to bear against.

11. The exterior wall system of claim 10 wherein the vertical seal chamber has holes along a vertical exterior face, thereby providing a means for inducing pressure equalization in the vertical seal chamber when air pressure differences experienced by the vertical seal.

12. The exterior wall system of claim 9 wherein plates are installed to span horizontally across the top and bottom of the seal assembly wherein the plates are buttered with silicone and attached to the top and bottom of the seal assembly.

13. The exterior wall system of claim 9 wherein the horizontal seals are buttered onto a top of the exterior insulated panels.

14. The exterior wall system of claim 9 further including caulking positioned proximate to the feet of either the base or top of the horizontal seal, and the feet define a height of the caulking.

15. The exterior wall system of claim 9 further including at least one positioning pin between the vertically adjacent exterior insulated panels.

16. The exterior wall system of claim 9, wherein the exterior and interior walls of the horizontal seal extending between the base and the top define at least one chamber.

17. The exterior wall system of claim 16, wherein the horizontal seal includes a chamber wall between the exterior wall and interior wall defining the at least one chamber into two chambers.

18. The exterior wall system of claim 17 wherein a horizontal exterior face of the horizontal seal has at least one hole formed therein to provide pressure equalization for the horizontal seal.

19. The exterior wall system of claim 16 wherein the horizontal seal includes a front extension.

20. The exterior wall system of claim 16 wherein the horizontal seal includes a front lip.

* * * * *